US011333009B2

(12) United States Patent
Archibald et al.

(10) Patent No.: US 11,333,009 B2
(45) Date of Patent: May 17, 2022

(54) CONVERTIBLE AND ADDRESSABLE SWITCH ASSEMBLY FOR WELLBORE OPERATIONS

(71) Applicant: GEODYNAMICS, INC., Millsap, TX (US)

(72) Inventors: Roger Archibald, Hurst, TX (US); Brad Perry, Santo, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 17/507,909

(22) Filed: Oct. 22, 2021

(65) Prior Publication Data

US 2022/0042399 A1 Feb. 10, 2022

Related U.S. Application Data

(63) Continuation of application No. PCT/US2020/056069, filed on Oct. 16, 2020.

(60) Provisional application No. 62/923,132, filed on Oct. 18, 2019.

(51) Int. Cl.
*E21B 43/1185* (2006.01)
*E21B 43/11* (2006.01)

(52) U.S. Cl.
CPC ..... *E21B 43/1185* (2013.01)

(58) Field of Classification Search
CPC ..... E21B 43/11857; E21B 43/1185; E21B 47/12; H01H 47/02; F42D 1/05
See application file for complete search history.

(56) References Cited

U.S. PATENT DOCUMENTS

| | | | | |
|---|---|---|---|---|
| 9,689,223 | B2 * | 6/2017 | Schacherer | E21B 43/117 |
| 10,767,453 | B2 * | 9/2020 | Phelps | H05K 1/11 |
| 10,830,566 | B2 * | 11/2020 | Maxted | F42D 1/043 |
| 10,914,146 | B2 * | 2/2021 | Archibald | H01H 47/02 |
| 2014/0151018 | A1 | 6/2014 | Lerche et al. | |
| 2015/0000509 | A1 | 1/2015 | Current et al. | |
| 2016/0237794 | A1 | 8/2016 | Maxted et al. | |

(Continued)

FOREIGN PATENT DOCUMENTS

| | | | | |
|---|---|---|---|---|
| EP | 2595319 | A1 * | 5/2013 | G08C 17/00 |
| WO | WO-2019147294 | A1 * | 8/2019 | H05K 1/11 |
| WO | 2019245800 | A1 | 12/2019 | |

OTHER PUBLICATIONS

International Search Report/Written Opinion dated Jan. 22, 2021 in related/corresponding PCT Application No. PCT/US2020/056069.

*Primary Examiner* — Daniel P Stephenson
(74) *Attorney, Agent, or Firm* — Morgan, Lewis & Bockius LLP

(57) ABSTRACT

A convertible and addressable switch assembly includes an interface (I/O) configured to connect to a controller along a telemetry system; and a processor connected to the interface (I/O). The processor is configured to receive a command from the controller, along the telemetry system, to change a first value of a mode status variable to a desired second value, wherein the first value is associated with a first operating mode of the switch assembly and the second value is associated with a second operating mode, which is different from the first operating mode; change the first value to the second value within the switch assembly; and store in a non-volatile memory, at the switch assembly, the second value of the mode status variable.

20 Claims, 12 Drawing Sheets

(56) References Cited

U.S. PATENT DOCUMENTS

| | | | | |
|---|---|---|---|---|
| 2019/0309608 | A1 | 10/2019 | Phelps et al. | |
| 2019/0323810 | A1* | 10/2019 | Saltarelli | F42D 1/05 |
| 2019/0390536 | A1* | 12/2019 | Archibald | E21B 43/1185 |

* cited by examiner

CONVERTIBLE AND ADDRESSABLE SWITCH ASSEMBLY FOR WELLBORE OPERATIONS

BACKGROUND

Technical Field

Embodiments of the subject matter disclosed herein generally relate to downhole tools for oil and gas operations, and more specifically, to a gun string having one or more addressable switch assemblies that can be converted, in firmware, to act in one of plural operational modes.

Discussion of the Background

After a well 100 is drilled to a desired depth H relative to the surface 110, as illustrated in FIG. 1, and the casing 110 protecting the wellbore 104 has been installed and cemented in place, it is time to connect the wellbore 104 to the subterranean formation 106 to extract the oil and/or gas.

The process of connecting the wellbore to the subterranean formation may include the following steps: (1) placing a plug 112 with a through port 114 (known as a frac plug) above a just stimulated stage 116, (2) closing the plug, and (3) perforating a new stage 118 above the plug 112. The step of perforating is achieved with a gun string 120 that is lowered into the well with a wireline 122. A controller 124 located at the surface controls the wireline 122 and also sends various commands along the wireline to actuate one or more gun assemblies of the gun string.

A traditional gun string 120 includes plural carriers 126 connected to each other by corresponding subs 128, as illustrated in FIG. 1. Each sub 128 may include a detonator 130 and a corresponding switch 132. The detonator 130 is not connected to the through line (a wire that extends from the surface to the last gun and transmits the actuation command to the charges of the gun) until the corresponding switch 132 is actuated. The corresponding switch 132 is actuated by the detonation of a downstream gun. When this happens, the detonator 130 becomes connected to the through line, and when a command from the surface actuates the detonator 130, the upstream gun is actuated.

For a conventional perforating gun string 120, carriers 126 are first loaded with charges and a corresponding detonator cord, to form plural gun assemblies. The gun assemblies are then built up, one gun assembly at a time, by connecting the loaded carriers 126 to corresponding subs 128. These subs contain the switch 132 with pressure bulkhead capabilities. Once the sub is assembled to the gun assembly, the wires and detonation cord are pulled through a port into the sub, allowing for the installation of the detonator, the corresponding switch, and the connection of the wirings. Those skilled in the field know that this assembly operation has its own risks, i.e., miswiring, which may render one or more of the switches and corresponding detonators unusable.

After the conventional gun assemblies have been placed together to form the gun string, none of the detonators are electrically connected to the through wire or through line running through the gun string. This is because between each gun assembly there is a pressure-actuated single pole double throw (SPDT) switch. The normally closed contact on these switches connects the through wire from gun assembly to gun assembly. Once the switch has been activated by the blast of the gun assembly beneath (when that guns goes off), the switch changes its state, connecting the through wire coming from above to one lead of the detonator. The other lead of the detonator is wired to ground the entire time.

In this configuration, after assembly, it is not possible to select which switch of the plurality of switches is to be activated. Once a fire command is sent from the controller 124, the most distal switch is activated. The blast from the corresponding gun assembly then activates the next switch and so on. However, new technologies are making use of an addressable switch, i.e., a switch that has a processor with an ID address, and the surface controller 124 is configured to send targeted commands to the desired addressable switch, based on the unique ID of each switch.

However, these addressable switches need to be configured, before being deployed into the well, to act as a traditional switch, or as a rapid fire switch, etc. Thus, based on the needs of the operator running the well, the manufacturer of the addressable switches program them in hardware to act as desired. This step of programming involves different firmware to be hard-coded onto the local processor of the switch. Once a switch has been packaged and prepared for delivery, it is not practical to re-program the processor as it requires a significant amount of skills and time to do so, and the packaging will prevent access to the connection points required for programming. Thus, currently, the operator of the well needs to exercise a significant level of forecasting to know how many of each type of switches to order from the manufacturer. This is problematic for the operator of the well as it is almost impossible to know in advance what type of switches and how many a given well would require.

Thus, there is a need to provide a downhole system that overcomes the above noted problems and offers the operator of the well the capability to select any operation mode associated with an addressable switch after the gun string has been delivered to the well.

SUMMARY

According to an embodiment, there is a convertible and addressable switch assembly that is part of a chain of switch assemblies in a gun string. The switch assembly includes an interface configured to connect to a controller along a telemetry system, and a processor connected to the interface. The processor is configured to receive a command from the controller, along the telemetry system, to change a first value of a mode status variable to a desired second value, wherein the first value is associated with a first operating mode of the switch assembly and the second value is associated with a second operating mode, which is different from the first operating mode, change the first value to the second value, and store in a non-volatile memory the second value of the mode status variable.

According to another embodiment, there is a method for firing a switch assembly that is part of a gun string. The method includes receiving power at the switch assembly from a surface controller, checking at the switch assembly a value of a mode status variable stored in a non-volatile memory, and based on the value of the mode status variable, initiating the switch assembly according to one of plural operating modes. Each of the plural operating modes is different from other operating modes of the plural operating modes.

According to yet another embodiment, there is a convertible and addressable switch assembly configured to be connected to a gun assembly in a gun string for firing the gun assembly. The switch assembly includes a processor ($P_A$) configured to check a value of a mode status variable, a memory configured to store (1) the value of the mode status variable and (2) a unique digital address that makes the switch assembly addressable, a through switch configured to allow a signal from a surface controller to pass to a next switch assembly; a detonator switch configured to close an electrical circuit to a detonator to detonate the detonator; and a transceiver configured to directly communicate with the next switch assembly. The value of the mode status variable is associated with plural operating modes. By changing the value of the mode status variable, the switch assembly is converted from one operating mode to another operating mode.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a convertible and addressable switch assembly that is converted in firmware not in hardware, using the telemetry system of the gun string, from one operating mode to another operation mode. The embodiments discussed herein are applicable to converting the convertible and addressable switch to among two or more operating modes.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 2:
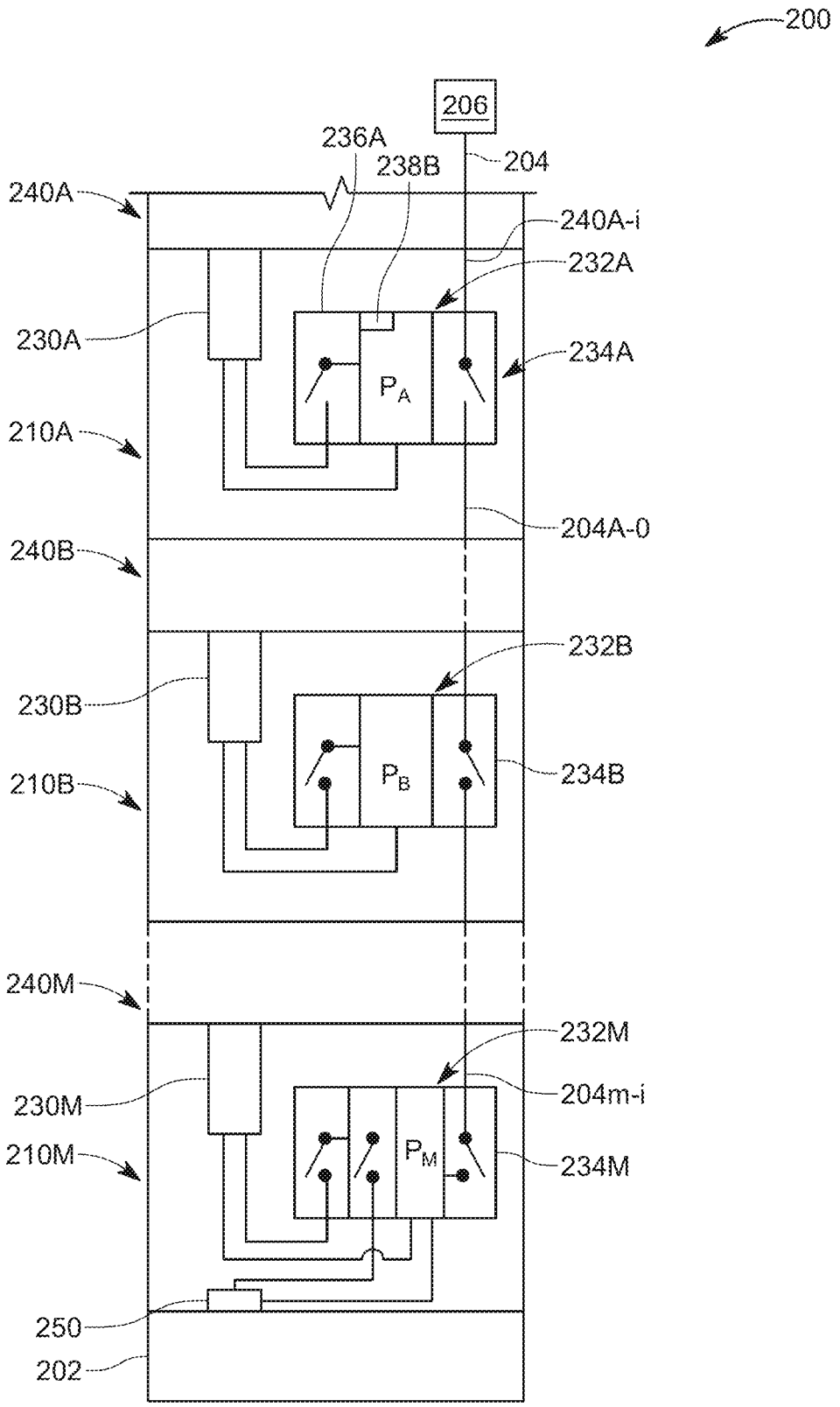
FIG. 2 illustrates a chain of addressable switch assemblies and associated gun assemblies.

According to an embodiment illustrated in FIG. 2, which corresponds to FIG. 2 of International Patent Application PCT/US2019/036538, which is incorporated herein by reference and is assigned to the assignee of this application, a gun string 200 includes plural gun assemblies 240 (shown as elements 240A to 240M, where M can take any numerical value) connected to each other through corresponding subs 210 (numbered 210A to 210M in the figure). In one application, no subs are used to connect the gun assemblies to each other. If no sub is used, the element 210 can be a detonator module that is attached to a corresponding gun assembly and hosts the switch assembly. Although FIG. 2 shows element 210 to be physically visible from outside the gun string, in one application it is possible to have either the sub or the detonator sub 210 completely located within one or two adjacent gun assemblies, so that the element 210 is not visible from outside when the gun string is fully assembled. Note that each gun assembly (except for the most upper gun assembly 240A and the most lower gun assembly 240M) is sandwiched by two subs or two detonator modules. The upper gun assembly 240A is considered to be the gun assembly first connected to the wireline (not shown in FIG. 2) and the lower gun assembly 240M is considered to be the gun most distal from the wireline, i.e., the gun assembly that is connected to the setting tool 202 if a setting tool is present.

Plural switch assemblies 232A to 232M and plural detonators 230A to 230M are distributed along the gun string 200. In this embodiment, each sub or detonator assembly 210 includes a corresponding switch assembly and a detonator, i.e., sub 210A includes switch assembly 232A and detonator 230A. The same is true for all other subs. In one application, the detonator may be located outside the sub. The detonator 230A is electrically connected to the switch assembly 232A and ballistically connected the corresponding gun assembly 240A. The same is true for the other gun assemblies, detonators and switch assemblies.

The switch assembly 232A (in the following, reference is made to a particular switch assembly, but it should be understood that this description is valid for any switch assembly in the chain of switch assemblies shown in FIG. 2) includes a processor $P_A$ (e.g., application-specific integrated circuit or field-programmable gate array or equivalent semiconductor device) that is electrically connected to two switches. A first switch is the thru-line switch 234A, which may be implemented in software, e.g., firmware, or hardware or a combination of both. The thru-line switch 234A is connected to a thru-line 204. The thru-line switch 234A is controlled in this embodiment by the processor $P_A$. The thru-line 204 may extend from a surface controller 206 along the wireline. The portion of the thru-line 204 that enters the switch assembly 232A is called herein the input thru-line 204A-i and the portion that leaves the switch assembly 232A is called the output thru-line 204A-o. When the thru-line switch 234A is open, power or other signals sent from the controller 206 down the well cannot pass through the switch assembly 232A, to the next switch assembly 232B. By default, all the thru-line switches 234A to 234M are open.

In this embodiment, the controller 206 can send not only commands, but can apply various voltages to the thru-line 204. This embodiment shows only a single line (the thru-line 204) extending from the controller 206 to the lower thru-line switch 234M. However, those skilled in the art would understand that more than one wire may extend from the controller 206 to the various switch assemblies. For example, a ground wire may extend in parallel to the thru-line. In this embodiment, the ground wire's role is performed by the casing of the gun assembly.

The switch assembly 232A also includes a detonator switch 236A, which is also controlled by the processor $P_A$. The detonator switch 236A may be implemented similar to the thru-line switch 234A. The detonator switch 236A is by default open, and thus, no controlling signal can be transmitted from the controller 206 or the processor $P_A$ to the corresponding detonator 230A. The switch assembly 232A may also include a memory 238A (e.g., EPROM memory) for storing a digital address and/or other information.

The digital address of a switch assembly may be assigned in various ways. For example, it is possible that all the switch assemblies have a pre-assigned address. In one application, it is possible that the switch assemblies have random addresses, i.e., addresses either assigned by the manufacturer of the memory or addresses that happen to be while the memories were manufactured. In still another embodiment, it is possible that a set of predetermined addresses were assigned by the manufacturer of the gun string.

Figure 1:
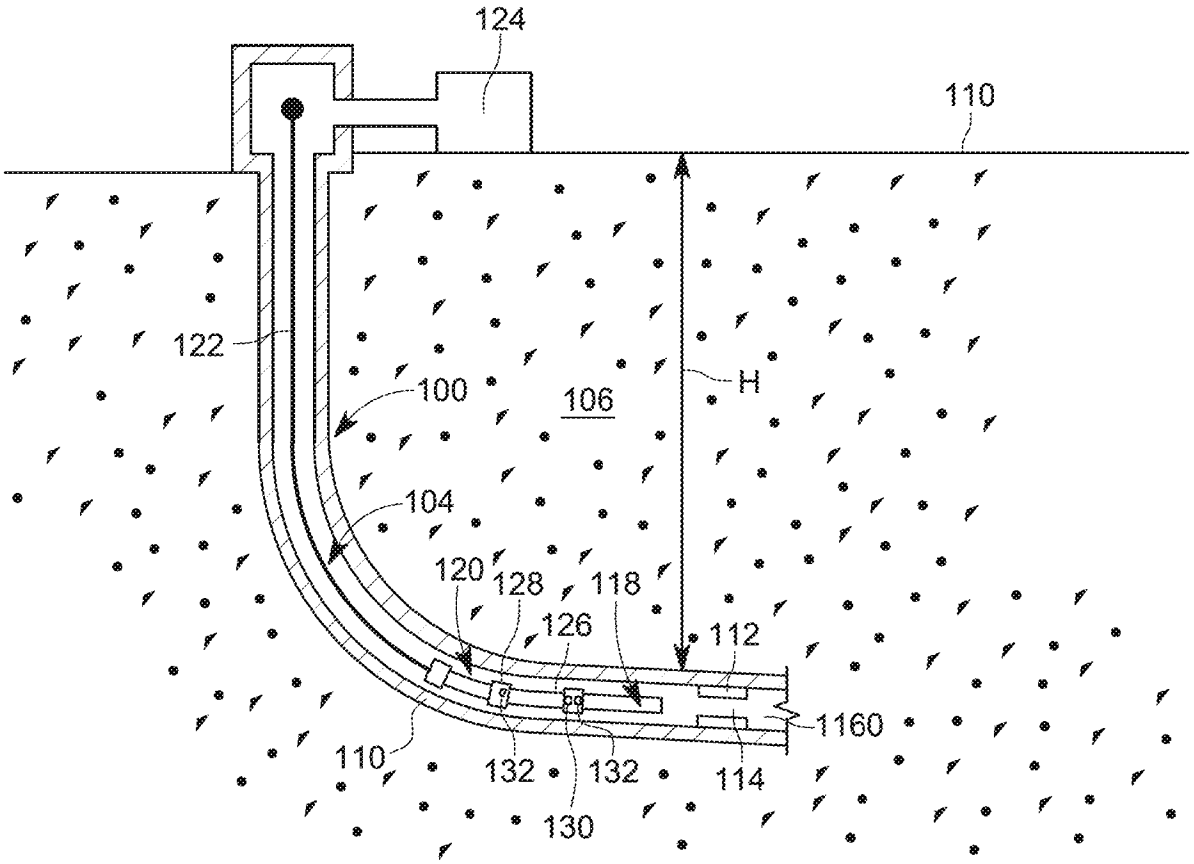
FIG. 1 (BACKGROUND ART)
FIG. 1 illustrates a well and associated equipment for well completion operations.

The lower switch assembly 234M is different from the other switch assemblies in the sense that the switch assembly 234M is also connected, in addition to the input thru-line 204M-i and to the detonator 230M, to a setting tool detonator 250. The setting tool detonator 250 may have the same configuration as the detonator 230M, but it is used to actuate the setting tool 202. The setting tool 202 is used to set the plug 112 (see FIG. 1). Thus, the lower switch assembly needs to distinguish between two modes: (1) firing the gun detonator 230M or (2) firing the setting tool 202. A method for achieving these results is discussed later.

Figure 3A:
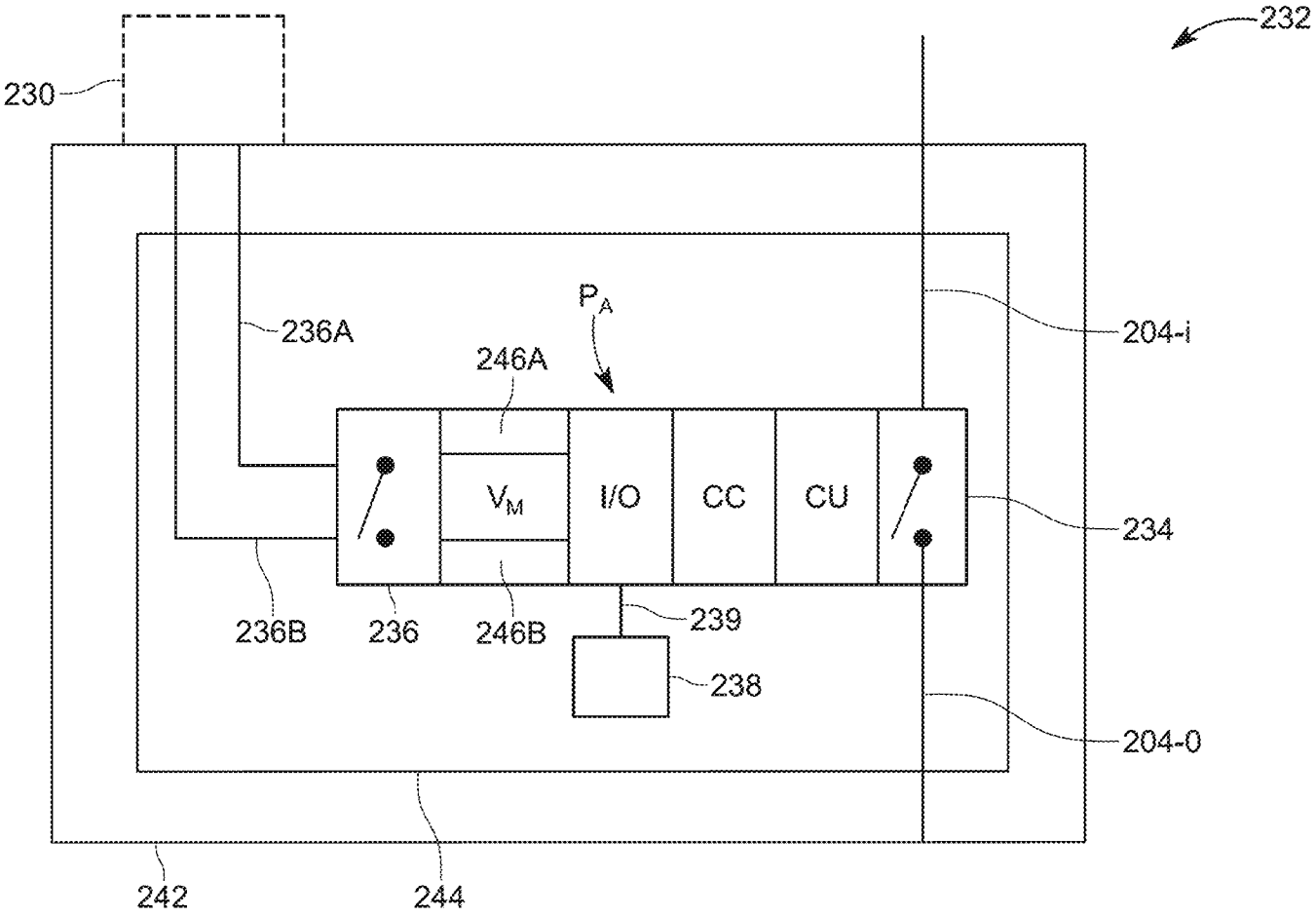
FIGS. 3A and 3B illustrate possible configurations of an addressable switch assembly.
Figure 3B:
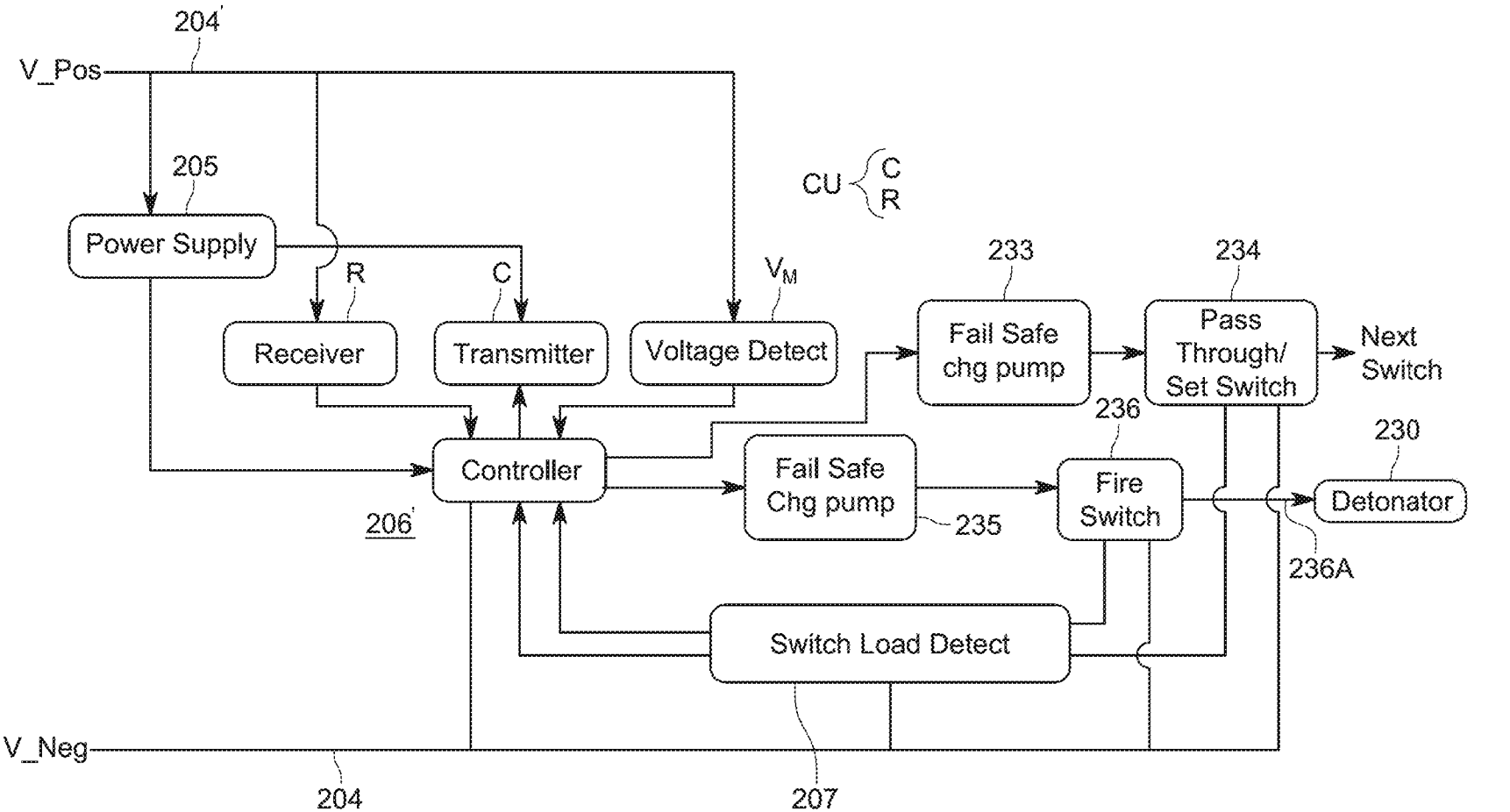

A configuration of an addressable switch assembly 232 (which can be any of the switch assemblies 232A to 232M discussed with regard to FIG. 2) is illustrated in more detail in FIGS. 3A and 3B. The addressable switch assembly 232 includes the thru-line switch 234 and the detonator switch 236. As discussed above, these two switches may be implemented in hardware (e.g., with semiconductor devices that may include one or more diodes and/or transistors) or in software or both. In this embodiment, it is assumed that the two switches are implemented in software (i.e., in the processor $P_A$). In this case, the two switches 234 and 236 in FIGS. 3A and 3B are logical blocks that describe the functionality performed by these switches and also their connections to other elements. This means that these logical blocks are physically implemented in the processor $P_A$.

The processor $P_A$ may also include a logical voltage measuring block $V_M$ that is configured to measure a voltage present in the thru-line 204, or more specifically, the input thru-line 204-*i*. Further, the processor may include an interface, for example, a logical or physical block I/O, that ca exchange various input and output commands with the controller 206 through the thru-line 204. Logical block I/O may also communicate with the voltage measuring block $V_M$ for receiving the measured voltage V and providing this value to the computing core CC of the processor for performing various calculations. Processor $P_A$ is connected to the memory 238 via a bus 239. Computing core CC is capable of storing and/or retrieving various data from the memory 238 and performing various calculations. In one embodiment, memory 238 is an erasable programmable read-only memory (EPROM), i.e., a non-volatile memory, which is a type of memory that retains its data when its power supply is switched off. This type of memory has the advantage of retaining an address and/or a mode status variable associated with the switch assembly when no power is supplied. Regarding power, it is noted that in this embodiment the switch assembly receives its power along the thru-line 204, i.e., there is no local power supply in the switch assembly or the sub.

The processor $P_A$ may further include a communication unit CU that is configured to exchange data with the controller 206. As will be discussed later, various commands could be sent by the controller 206 to a given switch assembly. The communication unit CU intercepts those commands (which are sent along the thru-line 204) and determines, in collaboration with the computing core CC, whether the commands are addressed to the specific switch assemblies. The communication unit CU is also configured to send an address (the digital address of the switch assembly, which is stored in the memory 238) of the switch assembly to the controller 206 upon a powering operation of the switch assembly. The communication unit CU may be configured to use any known communication protocol. The communication unit CU may be implemented in software, as a logical block in the processor $P_A$, as illustrated in FIG. 3A. However, the communication unit may also be implemented as dedicated hardware or a combination of hardware and software. For example, FIG. 3B shows the communication unit CU being implemented as a receiver R and a transmitter T. FIG. 3B also shows a local controller 206'.

The processor $P_A$ may further include one or more timers. FIG. 3A shows a first timer 246A and a second timer 246B. These timers may be implemented in software, and thus the blocks labeled 246A and 246B in FIG. 3A describe logical blocks associated with these timers. These timers may be implemented in controller 206' in the embodiment illustrated in FIG. 3B. However, in one embodiment, these timers may be implemented as dedicated hardware in combination or not with appropriate software. Although FIG. 3A shows two timers, one skilled in the art would understand from this description that only one timer may be used or more than two timers. The timers are configured to count a given time interval. For example, the first timer 246A may count down from 20 s while the second timer 246B may count down from 1 s. Other values may be used. Once the given time intervals have lapsed, the timers send a message to the processor indicating this fact. As will be discussed later, these timers may be used for implementing safety procedures regarding the firing of a detonator.

FIG. 3A further shows two wires (fire wires) 236A and 236B connecting the detonator switch 236 to the detonator 230. The embodiment of FIG. 3B uses only a single wire 236A for connecting the detonator switch 236 to the detonator 230. The two wires in FIG. 3A are connected to the detonator 230, which is not part of the switch assembly 232. However, one skilled in the art would understand that the detonator may be made part of the switch assembly. The elements discussed above with regard to the switch assembly 232 are located inside of a housing 242. The housing can be made of a metal, e.g., aluminum, or a composite material. In one embodiment, the switch assembly is located inside a detonator block 210, which is configured to also host the detonator. The entire switch assembly may be distributed on a printed circuit board 244, as schematically illustrated in FIG. 3A.

The embodiment of FIG. 3B shows that two lines 204 and 204' may enter the switch assembly, where one line has a positive voltage and the other line has a negative voltage. The switch assembly may have its own power supply 205 that supplies a DC voltage (e.g., 5 V) to the controller 206'. The embodiment shown in FIG. 3B also includes a failsafe mechanism 233 for the thru-line switch 234 and a failsafe mechanism 235 for the detonator switch 236. A switch load detect unit 207 detects whether or not there is an electrical load present on the output of switches 234 and 236. The switch load detect unit 207 reports the load status to controller 206', and this information is sent to the surface controller 206 and/or used by the downhole controller 206' in its decision-making tree.

The structure shown in FIG. 3A or 3B can be used for all the switch assemblies illustrated in FIG. 2, i.e., for the switch assemblies that are connected to a single detonator, but also for the lower switch assembly, which is connected to the gun detonator and the detonator of the setting tool. Previously, the setting tool required a separate and unique addressable switch for the actuation of the setting tool detonator. The switch assembly illustrated in FIGS. 3A and 3B eliminates the need for the setting tool switch, as the bottom gun addressable switch assembly's address allows that switch assembly to perform both functions of applying a shooting voltage to the detonator of the setting tool and afterwards, applying the same or a different shooting voltage to the detonator of the bottom gun assembly.

In addition, the switch assembly 232 can now be programmed remotely so that it acts in a first operating mode by default, for example, as a standard addressable switch, or in a second operating mode (e.g., as a rapid fire addressable switch), or in a third operating mode (e.g., as a set/fire addressable switch), or in a fourth mode (e.g., as a rapid fire set/fire switch). All these modes are discussed in more detail later. While this embodiment illustrates the capability of the same switch assembly 232 to be programmed to act according to four different operating modes, one skilled in the art would understand that the switch assembly may be programmed to act according to more or less operating modes. To convert the switch assembly 232 from one operating mode to another operating mode of the plural modes noted above, the existing telemetry system of the gun string can be used by the controller 206 and one or more instructions may be sent to the switch assembly to change a value of the mode status variable in the memory 238 associated with the processor $P_A$.

In this way, the operator of the gun string can use a single switch assembly part number for any well, and if the need is to have the switch assemblies to operate in a given operating mode, just prior to deploying the gun string into the well, a given bit of information in the memory 238 of the switch assembly 232 can be changed to the desired operating mode. While in this embodiment the operating mode of the switch assembly 232 is selected prior to deploying the gun string in the well, the same operation can be performed after the gun string has been deployed into the well. In one application, all the switch assemblies 232 are modified to operate according to a same selected operating mode. This means that if the switch assemblies are shipped to the operator of the well to operate in a given operating mode, the operator can change all the switch assemblies to operate in another operating mode. However, in one embodiment, it is possible to select only a subset of the switch assemblies using their digital address, and to change all these switch assemblies from the given operating mode to the another operating mode, and leave all the other switch assemblies unmodified. The details of how to convert an addressable switch assembly from one operating mode to another operating mode, and also how to determine in which operating mode a given switch assembly operates are discussed later.

The digital convertible and addressable switch assembly 232 of FIG. 3A or 3B is programmed to communicate with a surface logging and/or perforating system (e.g., controller 206), which provides improved safety and perforating reliability of individual gun control from the surface. The configuration shown in FIG. 2, which includes plural addressable switch assemblies, has the ability of firing a single gun assembly, generally starting at the bottom of the gun string. It also provides for skipping any one or more gun assembly in the gun string that may be defective, thereby continuing the perforating process of firing single gun assemblies with any of the remaining gun assemblies in a string.

The switch assembly 232 may be designed to provide an exact form replacement to the EB style switches currently in use in the industry. The electronic circuit board 244 of the switch assembly 232 may be potted within the metallic housing 242 by a thermally conductive, electrically isolation epoxy that also provides both electrical and mechanical shock survivability. The construction of the switch assembly has no moving parts, making it ruggedly built to withstand the blast of the perforating gun assembly and the downhole well pressure.

In one embodiment, each switch assembly's processor and/or memory is pre-programmed with a unique digital address, which is dynamically capable of being changed in the field. Each switch assembly is positioned within a sub connected to a gun assembly to enable the firing of that specific gun assembly while maintaining pressure containment to enable the intrinsically safe arming, and shooting of a single specific gun assembly. A gun string, as discussed above, then consists of multiple pre-assembled and tested gun assemblies typically connected, end to end, and lowered to the bottom of the production well. However, as discussed above, if no subs are used in a certain gun string, then the switch assemblies are positioned in other parts of the gun string.

The gun string is shot starting with the setting tool, which sets a drillable bridge plug. Before the perforation operation begins, the plug seal is hydraulically tested and afterwards the bottom gun assembly in the string is shot, followed by multiple gun assemblies being shot at pre-determined points along the course of the well bore. As each gun assembly is shot, the thru-line and electronics associated with the corresponding convertible and addressable switch assembly 232 is damaged/disabled by the pressure waves generated by the charges of the gun assembly. Therefore, the convertible and addressable switch assembly cannot be re-used for a second shooting. However, the mechanical housing 242 of the switch assembly 232 is configured to maintain the pressure integrity of the adjoining gun assembly and the electronic circuitry is reset to prevent voltage being applied to accidentally fire a next gun assembly.

Each switch assembly may be configured in software internal to the processor $P_A$ to provide the capability of firing a single gun assembly or, at the operator discretion, in the field, to be used as the bottom gun/setting tool switch. Also, each switch assembly has the capability of adjusting a given byte of its memory for indicating which operating mode to employ. The lower switch assembly's fire capability is selected at the final assembly of the gun string by changing the address, for example, to a pre-determined value to enable that functionality.

Figure 4A:
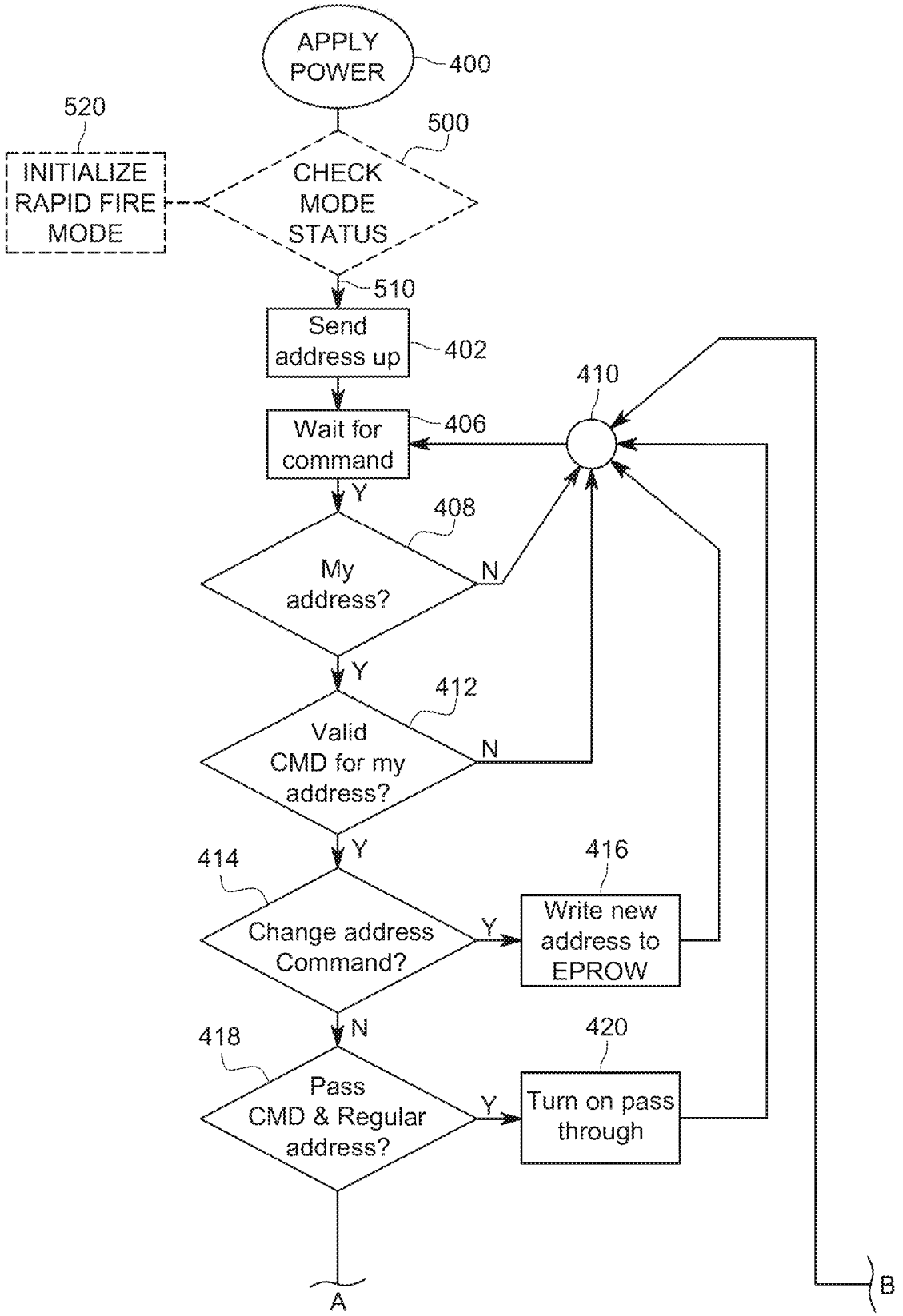
FIGS. 4A to 4C are a flow chart of a method for selecting an addressable switch assembly and actuating an associated detonator.
Figure 4B:
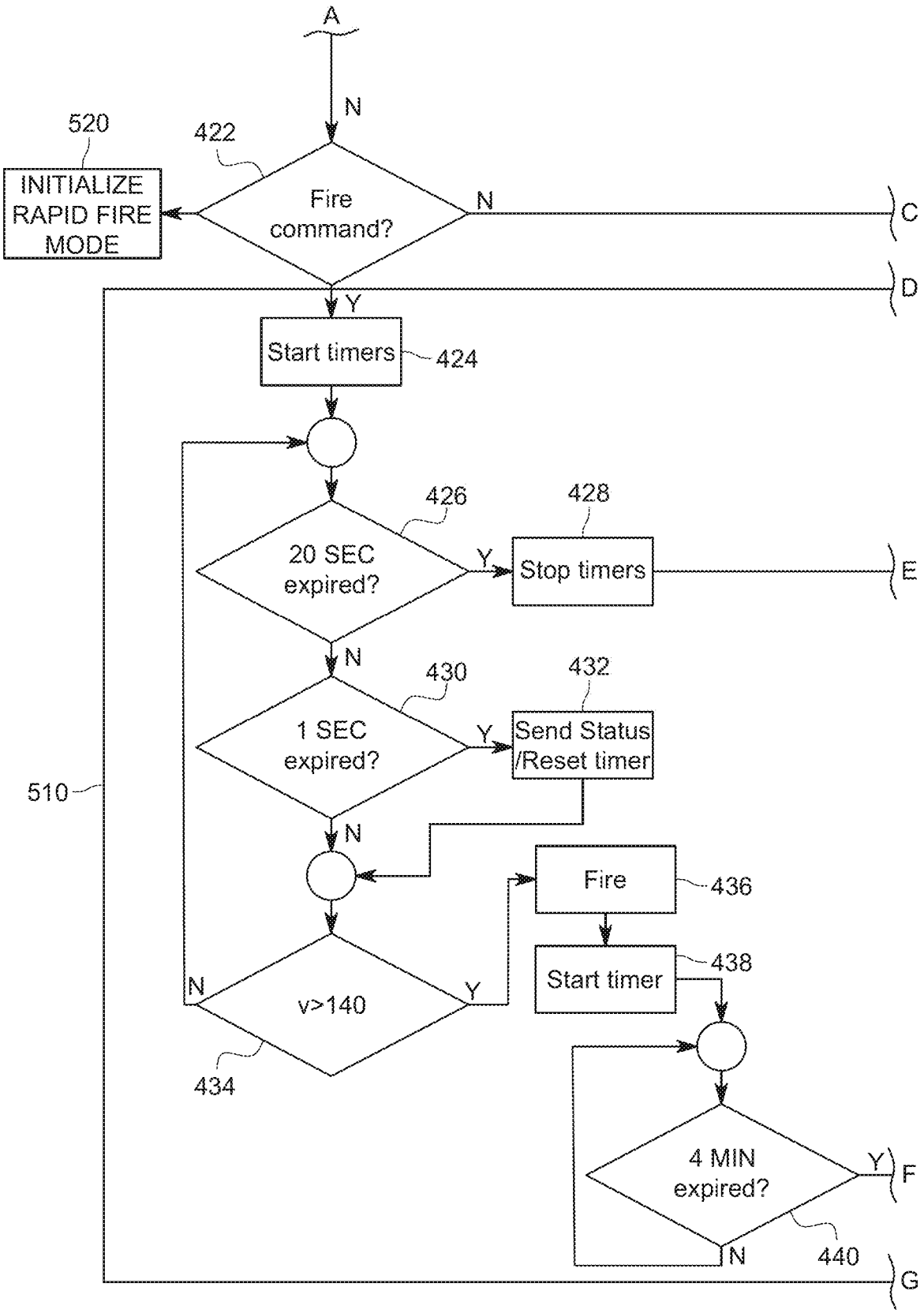
Figure 4C:
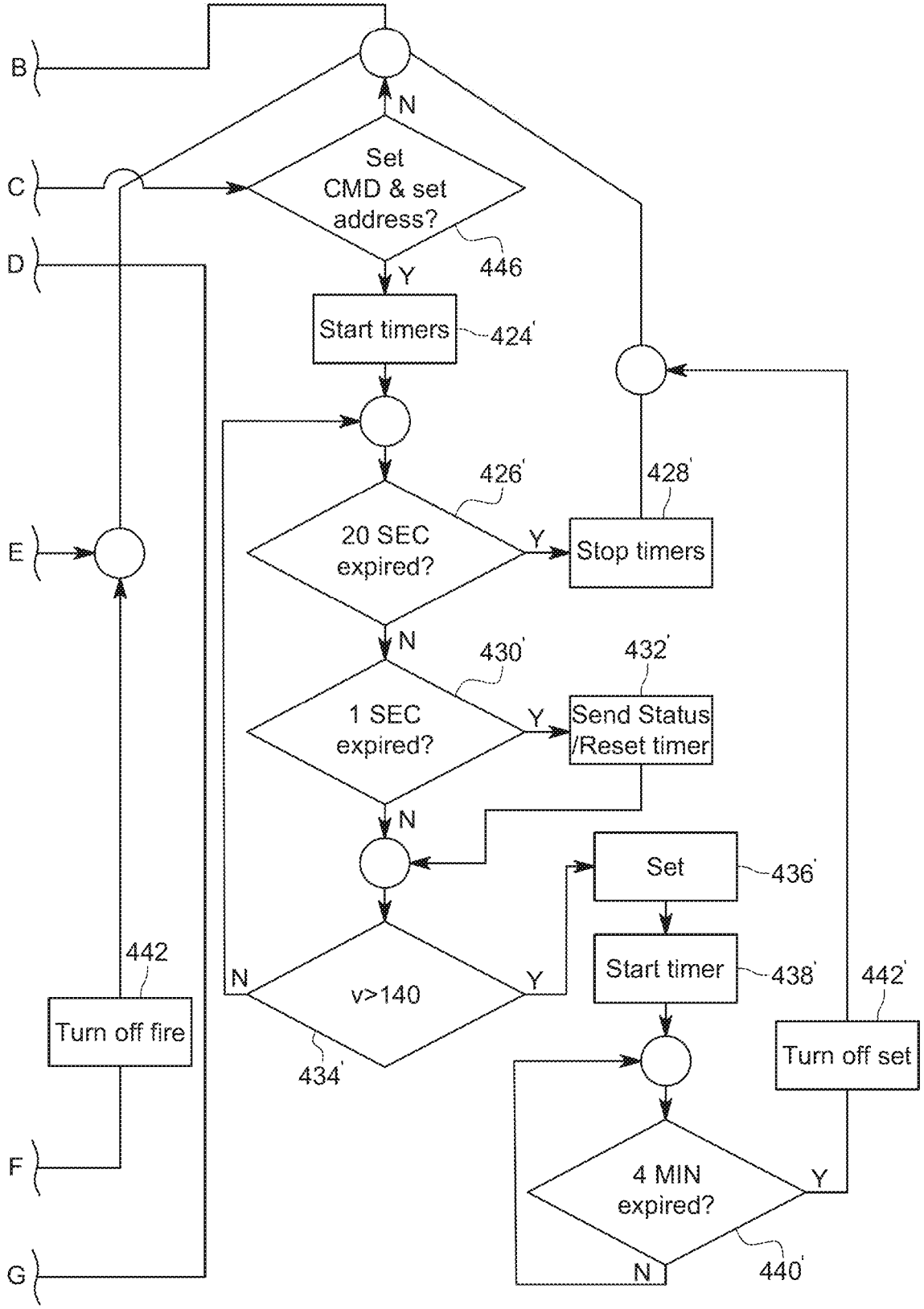

The selection of a given switch assembly and various operations and/or operating modes associated with the shooting of a gun assembly are now discussed with regard to FIGS. 4A to 4C. Suppose that the switch assemblies have been provided in the corresponding subs, and the subs have been connected to the corresponding gun assemblies so that the entire gun string is assembled. Also, suppose that all the switch assemblies have been programmed by the manufacturer to act as standard addressable switch assemblies, i.e., to operate in the standard operating mode. Either before the gun string is lowered into the well, or after the gun string has been deployed inside the well, power is applied in step 400 from the controller 206 (see FIG. 2) through the wireline (that includes the thru-line) to the gun string. At this time, as illustrated in FIG. 2, all the thru-line switches of the switch assemblies are open, which means that the power is received only by the upper switch assembly 232A, but not by the other switch assemblies.

Upon receiving power in step 400, the first switch assembly 232A sends in step 402 its digital address up to the controller 206. This digital address, as discussed above, can be pre-assigned by the operator of the gun string before assembling the gun string, can be pre-assigned by the manufacturer of the gun string, or can be a random address that was generated when the memory 238 was manufactured. In one embodiment, the digital address of the entire switch assembly can even be an incomplete address. After sending its digital address to the surface controller 206, the switch assembly waits in step 404 for a command from the controller 206.

Controller 206, upon receiving the digital address of the first switch assembly of the chain of switch assemblies, stores this address in an associated memory and maps the first switch assembly of the chain with this digital address. This mapping may be recorded in a table kept by the controller. The table would also include the digital addresses of all the switch assemblies in the chain, as each switch assembly is powered up.

After all the thru-line switches are closed and the controller is able to communicate with each of them, further commands may be sent from the controller. When a command from the controller 206 is sent along the thru-line 204, each switch assembly intercepts that command and verifies in step 408 whether an address carried by the command matches the address of the switch assembly. If the result of this step is NO, the process advances to step 410, which returns the process to the step 406 of waiting for a command. However, if the result of step 408 is YES, i.e., the command sent by the controller 206 is intended for the given switch assembly, the process advances to step 412, where a determination is made of whether the command is valid for the given switch assembly. For example, suppose that the command includes the correct digital address of the upper switch assembly 232A, but instructs it to fire the detonator of the setting tool. As previously discussed, the setting tool is controlled by the lower switch assembly 232M, not the upper switch assembly 232A. In this case, step 412 determines that the command, although addressed to the correct switch assembly 232A, it not valid for this switch assembly. Thus, the process is returned to step 406 for waiting for another command.

However, if the received command has the right digital address and is a valid command for the switch assembly 232A, then the process advances to step 414. In step 414, the processor of the switch assembly determines whether the command is related to (1) changing an address of the switch assembly, and/or (2) changing a value of a mode status variable at a given location in the memory 238. In one application, the given location is located in a non-volatile part of the memory 238. The mode status variable may take any number of desired values. For example, in one application, the mode status variable can take two values, 0 or 1, where 0 indicates "standard addressable switch" status and 1 indicates "rapid fire addressable switch," or the other way around. However, in another application, it is possible that more operating modes are implemented, in which case the mode status variable can take 4 or more values.

Thus, in block 414, the switch assembly 232 determines whether its digital address needs to be changed, or if its operating mode needs to be changed, or if both of these parameters need to be changed, or none of them need to be changed. If any of these parameters needs to be changed, then the process advances to step 416, during which the original digital address of the switch assembly is replaced with a new one selected by the operator of the chain, and/or the mode status variable is changed from one value to another value, i.e., the switch assembly is converted from one operating mode to another operating mode.

In other words, according to this step, the operator not only can dynamically assign new addresses to part or all of the switch assemblies of the gun string (due to the switch assembly addressable property), but also can change the operating mode (due to the convertibility property) of part or all of the switch assemblies as the field conditions of the well require. If a new address for the switch assembly and/or a new value for the mode status variable has been assigned in step 416, the new address and/or new value is written to the non-volatile part of the memory 238 and then the process returns via step 410 to the waiting step 406. Alternatively, if the original address of the switch assembly is incomplete, using the process described above, the operator is able to complete the address.

If the command from the controller 206 is not related to assigning a new digital address and/or a new value for the mode status variable, the processor $P_A$ checks in step 418 whether the command is related to a "pass" command. A pass command is designed to close the thru-line switch 234A so that power can be supplied to the next switch assembly 232B. If this is the case, then in step 420 the processor $P_A$ closes the switch 234A and the process returns to the waiting step 406.

If the command received in step 418 is not a pass command, then the process advances to step 422, where it is determined whether the command send by the controller 206 is a "fire" type command. A fire type command instructs the switch assembly to close the detonator switch for firing the corresponding detonator. As previously discussed, the switch assembly can be configured to fire the detonator in a standard mode or rapid fire mode or other modes as will be discussed later. At this step, the processor of the switch assembly checks the value of the mode status variable, and determines if the switch assembly should be initialized for standard operating mode or rapid fire operating mode. Note that although the switch assembly may be initialized for other modes, for simplicity, only these two operating modes are discussed herein.

Figure 5:
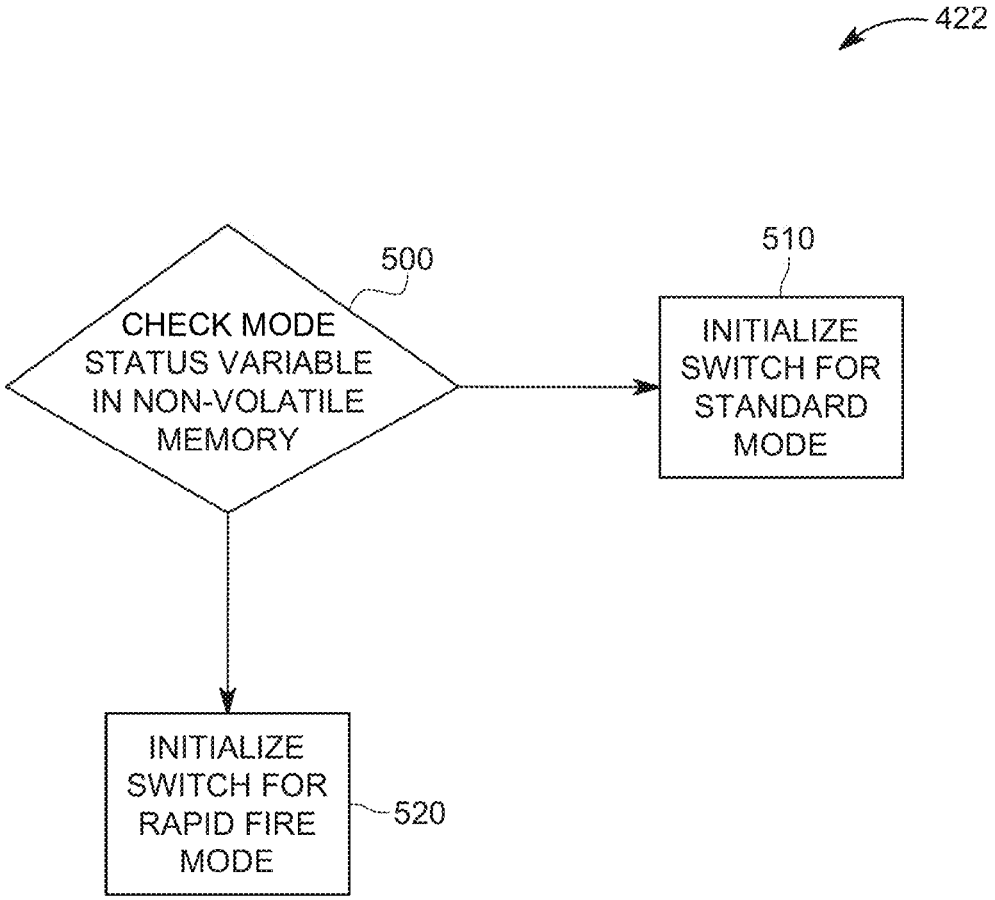
FIG. 5 illustrates in more detail a step of selecting an operational mode of a converting and addressable switch assembly.
Figure 7:
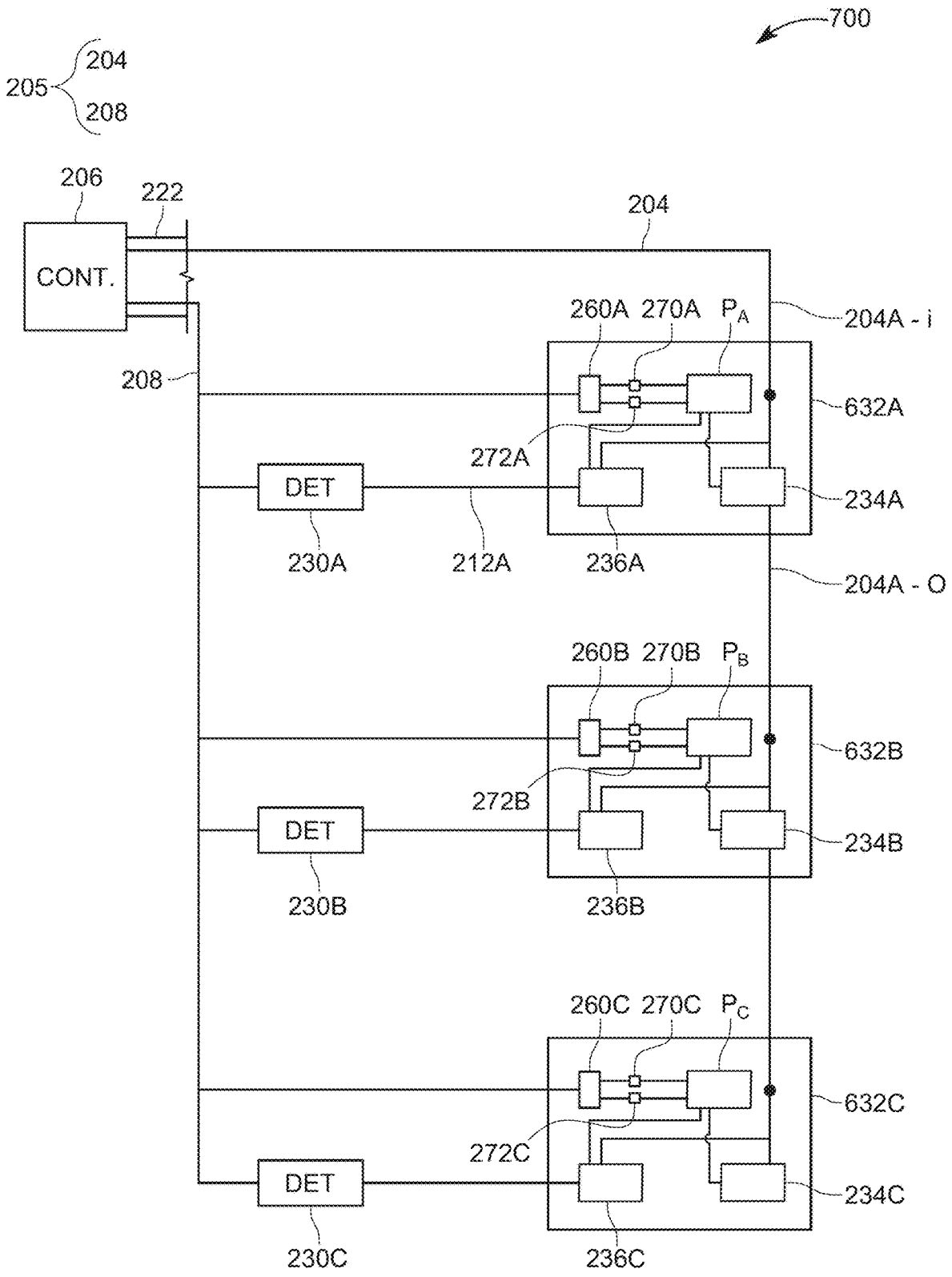
FIG. 7 illustrates a chain of convertible and addressable switch assemblies distributed in a gun string.

In this regard, FIG. 5 illustrates step 422 in more detail, and shows that upon receiving the command from the controller 206, the processor of the switch assembly 232 checks in step 500 the mode status variable stored in the non-volatile memory, and determines that the switch assembly should be initialized for the standard operating mode 510, which is detailed in steps 424 to 442, or determines that the switch assembly should be initialized for the rapid fire operating mode in step 520, which is discussed later with regard to FIG. 7. Thus, the steps 510 and 520 prepare the switch assembly according to the desired operating mode. In one application, it is possible to implement step 500 directly after applying the power in step 400, in FIG. 4A. For this reason, steps 500 and 520 are illustrated with a dash line after step 400. One skilled in the art would understand that steps 500, 510, and 520 may in fact be performed anywhere along the chain of steps shown in FIG. 4A, before step 422.

If the command in step 422 is a fire command and the value of the mode status variable corresponds to the standard operating mode, then the process advances to step 424, at which point the first timer 246A is started. Note that step 422 has already initialized the switch assembly to act in the standard fire mode or a rapid fire mode, or other modes that are discussed later. The first timer 246A may be programmed to count down a first time interval, e.g., a 20 s period. Other time periods may be used. The processor checks in step 426 whether the time period has elapsed. If the answer is yes, then the process stops in step 428 the first timer (and other timers if they have been started) and returns to the waiting step 406.

A second timer 246B may also be started in step 424. Starting this second timer is optional. If this second timer is present and started, then it counts down a second time interval, shorter than the first time interval of the first timer. In one application, the second time interval is about 1 s. When the processor determines in step 430 that the second time interval has lapsed, the processor sends in step 432 the status of the switch assembly (e.g., whether the switches are closed or open, whether a voltage has been measured, the value of the mode status variable, etc.) back to the controller 206. Further, in the same step 432, the second timer is reset to count down again the second time interval.

The purpose of these two counters is now explained. Returning to step 422, assume that a fire command has been send from the controller 206 to the switch assembly 232A. To actually fire the detonator associated with this switch assembly, it is not enough to only send the fire command (first condition) because that command may be send in error. Thus, a second condition needs to happen in order to actuate the detonator. This second condition is the detection in step 434 of a parameter (e.g., voltage) characterizing the thru-line 204 and determining whether a value of this parameter is larger than a given threshold. For example, the threshold voltage can be 140 V. Other values may be used. Note that a voltage in the thru-line during normal operation is much less than the threshold voltage, e.g., about 30 to 40 V. Those skilled in the art would understand that other parameters than voltage may be used, for example, a given frequency.

In this regard, the controller 206, which has the ability to change the value of the mode status variable in the non-volatile part of the memory of each switch assembly, is configured to operate in a low voltage mode when interacting with the switch assemblies for setting the values of their mode status variables. This is to prevent an accidental firing of the detonator. Thus, in this mode, the controller 206 is configured to generate signals having an electrical power at a percentage of the minimum fire current needed by the detonators to be fired. In one application, the controller operates at about 10% of the minimum fire current needed to detonate the detonator, i.e., at a reduced current. Other values for this percentage may be used. This makes safe the process of changing the value of the mode status variable of each switch assembly while the gun string is live. Thus, the controller 206 verifies all the switch assemblies that they are able to communicate and they are able to detect their detonators, while using the reduced current. Also, the controller 206 operates at the reduced current to configure the switch assemblies to function in a desired operating mode, e.g., standard mode, rapid fire mode, set/fire switch mode, etc. In one application, as discussed later, the controller 206 is capable of configuring all the switch assembly to act in the standard operating mode, and to configure the most bottom switch assembly as a set/fire switch just prior to running the gun string into the well. The controller 206 includes, in one embodiment, a display that displays all this information to the operator of the well in real time and records the results of each test in its non-volatile memory for later analysis and download.

Thus, after the fire command was received in step 422 and the first timer was started in step 424, if a voltage increase above the threshold voltage is not detected (second condition for firing) in step 434, the process returns to step 426. If the first timer has counted down the first time interval, as a safety measure, because the second condition has not been fulfilled, the process stops the timers in step 428 and returns to the waiting step 406.

While the process loops from step 434 back to step 426 and so on during the first time interval, the second timer 246B counts down the second time interval, which is much shorter than the first time interval, which results in information about the status of the switch assembly being sent in step 432 to the operator of the gun string. In this way, the operator is constantly appraised about the status of the switch assemblies. Note that this bidirectional exchange of information between the controller 206 and a given switch assembly happens in the standard operating mode but not for the rapid fire operating mode. For the rapid fire operating mode, no commands or data is exchanged between the surface controller and the switch assembly, as discussed later, which makes this mode to be "rapid."

However, if a voltage increase above the threshold voltage is detected by the voltage measurement unit $V_M$ in step 434 while the first time interval has not lapsed, then the process advances to step 436 to fire the detonator 230A. Note that different from all the existing methods in the field, the ultimate/final decision to fire the detonator is made at the switch assembly level, i.e., by the local processor $P_A$, and not by the surface controller 206. In other words, while the initial decision to fire a gun assembly is made by the operator of the gun string at the controller 206, the final decision to actually fire that gun assembly is made locally, at the switch assembly (in step 434). This two-step decision method ensures that the initial decision was not a mistake and also prevents firing in error the detonator.

As a further safety measure (a fail-safe measure), a third timer (or the first timer) is started in step 438 and is instructed to count down a third time interval. The third time interval may be larger than the first time interval, for example, in the order of minutes. In this specific embodiment, the third time interval is about 4 min. If the detonator was actuated in step 436, as previously discussed, the detonation of the charges in the gun assembly would likely destroy the switch assembly 232A and thus the process stops here for this specific switch assembly.

However, in the eventuality that the detonator failed to actuate, for any reason, when the processor PA determines in step 440 that the third time period has elapsed, it locally decides to turn off the fire process in step 442 and the process returns to the waiting step 406. The processor may also send a status report in step 442 to the controller 206 informing that the fire process has failed. Thus, the operator may decide to repeat the firing process or decide to skip the firing of this gun assembly. Irrespective of the decision of the operator, to fire the next gun assembly, the operator again sends a command to a next switch assembly, and repeat the procedure described in FIGS. 4A to 4C.

However, this standard operating mode of firing the detonators is slow because of the commands and/or data exchanged between the global controller 206 and the processor $P_A$ of each switch assembly. If the switch assemblies are configured to act according to the rapid fire operating mode, then most of the steps shown in FIGS. 4A to 4C are avoided, as discussed later, and the firing time is reduced.

The processes discussed above apply to any of the switch assemblies shown in FIGS. 3A and 3B. Once the pass command has been applied to each switch assembly, the controller 206 is capable of instructing any of the switch assemblies, irrespective of their position in the chain of switch assemblies, to fire its corresponding detonator, due to the selectivity afforded by the unique digital address of each switch assembly. This feature is reflected in step 408, which checks for a match in the digital address sent by the controller 206 and the digital address of each switch assembly.

Next, the process of firing the detonator of the setting tool and not the detonator of the gun assembly associated with the lower switch assembly is discussed. If a command having the address of the lower switch assembly 232M is sent (see step 408 that verifies the address), and the command is valid (step 412), and the command is neither a change address command (see step 414) nor a pass through command (see step 418), and the command is also not a fire command (see step 422), then the processor $P_A$ determines in step 446 whether the command is associated with the detonator of the setting tool. If the answer is no, the process returns to the waiting step 406. If the answer is yes, the process advances to step 424', which is similar to step 424 discussed above, except that step 424' is applicable to the setting tool detonator 250 (see FIG. 2) associated with the setting tool 202.

The following steps 426' to 442' are similar to the corresponding steps 426 to 442 and thus, their description is omitted herein. The same safety features are implemented for the setting tool as for the gun assembly, i.e., the first to third timers. Note that actuating the detonator of the setting tool is possible only for the lower switch assembly 232M as this switch assembly is the only one that can execute a setting tool command. This is possible because the lower switch assembly 232M checks whether the mode status variable in the received command has a first value or a second value. The first value is associated with a fire command while the second value is associated with a setting tool command. Thus, when a command from the controller 206 is received and includes the digital address of the lower switch assembly 232M and the mode status variable has the first value, the processor follows steps 424 to 442. However, if the command includes the digital address of the lower switch assembly 232M and the mode status variable has the second value, the processor follows steps 424' to 442'.

The setting tool associated address is set up by the controller 206 in step 414. As previously discussed, each switch assembly has a complete or partial address, either pre-assigned or randomly assigned during the manufacture process of the memory. In step 414, when the controller 206 determines that the switch assembly 232M is the last one in the chain of switch assemblies, the controller 206 may assign an additional address to the lower switch assembly 232M. This additional address is directly linked to the setting tool 202 and it is checked in step 446 discussed above.

Returning to the concept of dynamically addressing a switch assembly (see steps 414 and 416 in FIG. 4A), the following aspects are further discussed for clarification. According to this method, it is possible to set switch addresses in a gun string during the initial testing, after a gun string has been assembled or at any other time. The procedure of dynamic addressing may be accomplished using a test box or a control system designed for this purpose, for example, the controller 206.

In one application, upon power being applied to the chain of switch assemblies, the first switch assembly powers up, performs internal testing of its circuits, and tests for the presence of a detonator. After a short delay, it sends up this information (see step 402) to the test box with an uninitialized address. The test box will recognize this address and sends a command (see step 414) which instructs the switch assembly to reprogram its address to the one sent in the command. The test box then sends the "pass through" command in step 418. At this point, the switch assembly will "pass through" the voltage to the next switch assembly in the chain, and the process is repeated until all the switch assemblies in the chain are accounted for.

During the operation of the gun string, the surface logging and/or perforating system (i.e., controller 206) may poll the gun string. This polling process is initiated by applying power to the upper switch assembly 232A in the gun string. Upon powering up, the upper switch assembly transmits its address up the wireline and the value of the mode status variable and then automatically reverts to a low power listening mode state. The controller 206 receives and identifies the unique address of the switch assembly and its mode status variable and positions this switch assembly in the gun string. Then, the controller 206 transmits a digital code (pass through command) back down-hole to the switch assembly that instructs the switch assembly to apply power to the next switch assembly in the string below.

Power is then applied to the next switch assembly down the gun string. The process is repeated for each switch assembly or any number of gun assemblies in a gun string. When the controller 206 detects the lower switch assembly in the string, a record of the number, address and position in the gun string of all the switch assemblies is recorded.

As previously discussed, the switch assemblies have been designed with a plural purpose operation mode variable. In one application, the switch assembly can be set for (1) a standard operating mode firing with pass through, (2) or rapid fire operating mode with pass through, or (3) a setting tool operating mode firing, or (4) a ballistic release tool operating mode, or (5) with any combination of these modes. The setting tool operating mode can be used for a setting tool and the associated lower gun assembly. A unique value may be used to determine which mode to be used. The setting tool mode will follow the same fire procedure to set a plug as discussed above with regard to FIGS. 4A to 4C.

After all the switch assemblies in the gun string are powered up and all the digital addresses are recorded, but the rapid fire operating mode is not detected, all the switch assemblies in the gun string are in the "wait for command," low power consumption mode. The operator may then select any switch assembly in the gun string and send a "Fire Command." Note that the operator does not have to start with the lower gun assembly. With the addressable switch assemblies discussed herein, the operator has the freedom to actuate any switch assembly, wherever positioned in the chain of the switch assemblies. The unique digital address code for a specific switch assembly in the gun string is transmitted immediately followed by a unique digital coded fire command. Once the correctly addressed switch assembly understands its address code, it checks which operating mode to initiate, and then the command initiates an internal timer (see step 424). Inside this timer loop, the switch assembly sends up the wireline a status/reset code (see step 432) at 1 second interval giving the operator a visual indication of the ready to fire state of the switch assembly. This timer loop is user programmable from 10 to 60 seconds and indicates the time remaining before the switch assembly will abort the fire command and revert back to normal operation in its previously configured state. Note that the time interval with which the one or more timers are programmed in the switch assembly may be programmed before the switch assemblies are lowered into the well, but also after they are placed inside the well (see step 414).

The switch assembly's internal voltage measurement circuits monitors the thru-line voltage. If the line voltage is increased above the threshold voltage (e.g., 140 Volts) before the first timer times out, the voltage is applied to the detonator that is hard wired to the switch assembly by closing the detonator switch. If the voltage is not increased within the time allotted by the first timer, the fire command is aborted and must be re-sent from the surface system to start another time out window. Once the voltage is above the threshold voltage and the line has been connected to the detonator, another timer (third timer, see step 438) is started. In one application, this timer is about 4 minutes and ensures that the detonator is disconnected from the line in case the detonator does not fire for any reason.

However, if a switch assembly has a value for the mode status variable that corresponds to the ballistic release tool mode, then this specific switch assembly interacts differently from all other switch assemblies as now discussed. Many operators use a Ballistic Release Tool (BRT) with the gun string, and the BRT is a tool that can use an addressable switch assembly to initiate a ballistic reaction to separate the gun string from its wireline or other tool that is used to lower the gun string into the well. The BRT is useful in the event that the gun string becomes stuck in the hole at some point below the BRT, as the operator has the option to separate the wireline from the gun string at the location of the BRT, and then be able to recover the wireline and bring it back to the surface without the gun string. The gun string may be recovered at a later time using methods capable of pulling harder than the wireline is capable of pulling. The risk of using an addressable switch assembly, which is configured to act in the standard operating mode, in a BRT mode is that it creates a relatively high probability that a user inadvertently releases the gun string when the user is intending to shoot one of the top gun assembly in the gun string.

Thus, the switch assembly discussed above can be programmed with a specific address or specific value for the mode status variable, which places the switch assembly in the BRT mode. When the switch assembly is in the BRT mode, it behaves differently from the other switch assemblies. On power-up, the switch assembly in the BRT mode does not send its address in step 402, as discussed above with regard to FIG. 4A, but rather it listens for a command to be sent specifically from the controller 206 to its address, i.e., the switch assembly configured in the BRT operating mode does not "speak unless spoken to." In the event that the operator wants to release the gun string, they can send a 'Release' command to the specific BRT switch assembly address, and that will start a release sequence, which can be identical to the fire sequence described in steps 424 to 442 or 424' to 442' discussed above with regard to FIGS. 4A to 4C, with the exception that it can only be started on the 'BRT' initiated switch assembly by sending the 'BRT Release' command. While most switches will enable their passthrough on reception of a 'Pass' command as discussed above with regard to step 418, the BRT switch assembly will monitor the line voltage and enable its passthrough at the moment the line voltage passes beyond a minimum threshold (e.g., 35V). This enables the operator to power up the line to a lower voltage (for example 30V) and communicate with the BRT switch assembly without the BRT switch assembly enabling its feedthrough and powering up the lower switch assemblies. For this mode, it is thus possible to modify step 402 to check at that time the value of the mode status variable, and if the value coincides with the value associated to the BRT operating mode, that specific switch assembly does not send up its digital address.

The previous embodiments discussed how various commands are sent from the controller 206 to the switch assemblies and how the switch assemblies sent various information (e.g., their digital addresses or their status) to the controller. Thus, a bi-directional communication was established between the controller and the switch assemblies for the standard operating mode. However, this bi-directional communication takes time and limits the possibility of quickly firing the shaped charges of the various gun assemblies of the gun string. Thus, as discussed next, there is possible to implement a different scheme for firing the gun assemblies without data exchange between the surface controller 206 and the plural switch assemblies, and this is the rapid fire operating mode.

Figure 6:
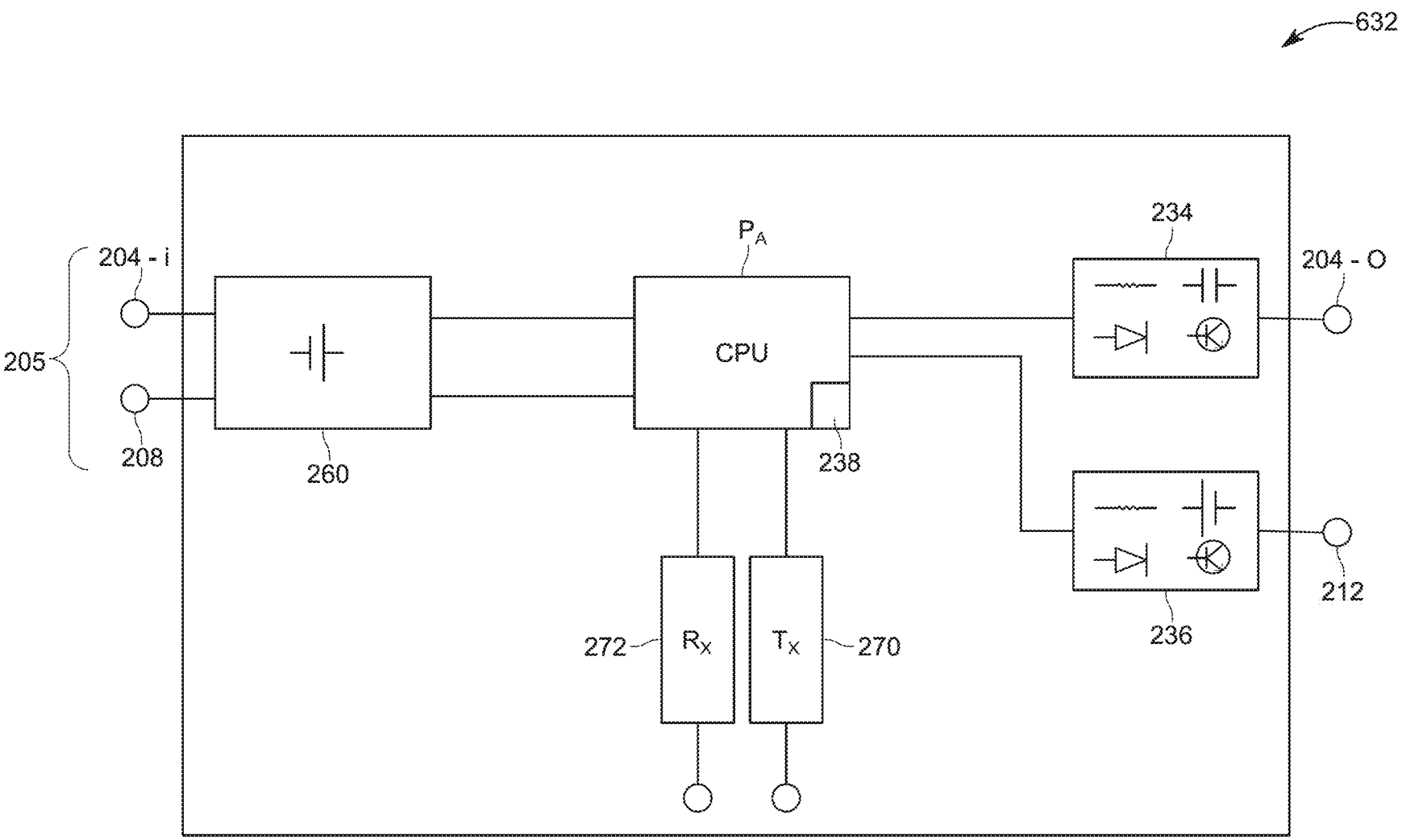
FIG. 6 illustrates a configuration of the convertible and addressable switch assembly.

According to this embodiment, as illustrated in FIG. 6, the switch assembly 232 may be modified to support the rapid fire operating mode by including a power supply 260, which is configured to provide various voltages to the switch assembly independent of the controller 206. For example, power supply 260 may include one or more transistors, diodes, resistors and capacitors. In one application, power supply 260 is connected to a telemetry system 205 that includes wires 204 and 208, and communicates with the controller 206. The telemetry system 205 is carried by the wireline 222 from the surface into the well, to each switch assembly, as illustrated in FIG. 7. The power supply 260 may also generate various DC voltages, e.g., 12 V and 5 V for internal nodes of this switch assembly 632. Note that the configuration of the switch assembly shown in FIG. 6 is described in International Patent Application PCT/US2019/036538, assigned to the assignee of this application, the entire content of which is incorporated herein by reference. However, the switch assembly in this PCT application was not configured to enter a different operating mode than the rapid fire operating mode, i.e., it was not configured to be a convertible switch assembly.

Processor $P_A$, which is schematically illustrated in FIG. 6 but has the same structure as the processor $P_A$ in FIG. 3A, is connected to a transmit module 270 and a receive module 272, both of which are added to the switch assembly 232. The transmit module 270 and the receive module 272 may be considered to be a transceiver. With these transmission elements, the previous addressable switch assembly 232 becomes a convertible and addressable switch assembly 632, as now discussed. Note that the convertible and addressable switch assembly 632 can still perform all the functions and has all the capabilities of the addressable switch assembly 232. However, by adding the power source and the transceiver, the convertible and addressable switch assembly 632 can now also perform the rapid fire operating mode, or any of the modes previously discussed. Each of these receive and transmitter modules is implemented in hardware and may include, for example a transistor and a resistor. It is noted that a generic transmit module or receive module or switch assembly or processor is indicated in FIG. 6 by a corresponding reference number (e.g., 632) while the same element, when present in a chain of switch assemblies, is indicated by the corresponding reference number followed by a letter (e.g., 632A) that is specific to each switch assembly in the chain.

The functionalities of the convertible and addressable switch assembly 632 (simply called "switch assembly" herein) shown in FIG. 6 are now discussed with regard to FIG. 7. The switch assembly 632 can also be used in the standard operating mode, as the entire structure of the switch assembly 232 is present in the switch assembly 632. The additional structure shown in FIG. 6 about the switch assembly enables the rapid fire converting mode. This means that the switch assembly 632 can be used in either mode, by simply changing the value of its mode status variable. Therefore, if the operator of the well uses the switch assembly 632, any of the modes discussed herein can be implemented by using a same switch assembly configuration. This is not possible with the existing switch assemblies.

For simplicity, FIG. 7 shows a gun string 700 that includes only three switch assemblies. However, a gun string may have any number of switch assemblies. Also for simplicity, each switch assembly is shown as a box having two switches, one micro-processor, one transmit module and one receive module. The switch assembly 632A is considered to be closest to the top of the well and the switch assembly 632C is considered to be closest to the toe of the well. This means that the switch assembly 632A may also be programmed to use the BRT operating mode while the switch assembly 632C may be programmed to use the set/fire operating mode. For the other switch assemblies 632, the BRT and the set/fire operating modes are not required, but they can be implemented if so desired by the operator of the well. The charges and other physical elements that are attached to the gun assemblies or make up the gun assemblies are omitted for simplicity herein. The figure shows only the three switch assemblies and their electrical connections to other switches, to a controller from the surface, and to their detonators.

When a switch assembly 632 is processed by the controller 206 to act in the rapid fire operating mode, each switch assembly acts as a hybrid switch assembly, i.e., it does not need to have a digital address and no commands need to be received from the surface to fire the hybrid switch assembly. If the switch assembly 632 is programmed to work in the rapid fire operating mode, the switch assembly would go through various state machines. In one implementation, each switch assembly goes through 6 state machines, as now discussed. Those skilled in the art would understand that the switch assemblies may be go through more or less state machines, depending on the value of the associated mode status variable.

After the string of switch assemblies is powered up with a selected voltage, similar to the embodiment illustrated in FIGS. 4A to 4C, and the processor of the switch assembly determines in step 500 that the value of the mode status variable corresponds to the rapid fire operating mode, the method advances to step 520 which is now detailed. In this operating mode, the selected voltage (called herein powering voltage) could be a negative voltage between 20V and 90V, which is applied between wires 204 and 208 in FIG. 7. Other voltages may be used. Once the chain of switch assemblies is powered up, each switch assembly makes a determination on whether or not it is able to fire the corresponding detonator. Then, the switch assembly communicates locally, with an adjacent switch assembly (usually located further downhole) to determine whether or not there is a switch below it, which is also able to fire. Note that in the rapid fire operating mode, the communication of a switch assembly is mainly directed to an adjacent switch assembly, and not to the controller 206. This saves time as most of the commands required by the standard communication protocol between a switch assembly and the surface controller 206 are eliminated. For this reason, this operating mode is a rapid fire mode.

As each switch assembly makes this determination, it will send a pair of voltage pulses to the surface controller 206. The surface controller 206 can interpret these pulses to determine how many switch assemblies are online, knowing that the bottom switch assembly 632C will fire when the line voltage is increased above a firing voltage. In this implementation, the firing voltage is larger than 140V. Then, the surface controller increases the line voltage to be larger than the firing voltage, and the bottom switch assembly, upon detection of this increase in voltage, and within a certain time window, fires the detonator associated with it.

After a switch assembly is fired, the power to the chain of switch assemblies is interrupted and then reapplied to the entire chain, so that the configuration process described in previous steps is repeated after each firing, to determine again which is the current bottom switch assembly. If a wiring issue or electronics failure downhole prevents a switch assembly from being able to fire, the switch assembly above it will automatically become the last switch assembly in the string, with no interference from the controller 206. This means that this process is independent of any instructions from the surface controller 206, i.e., requires no commands from the surface controller, which expedites the firing process and makes the rapid fire operating mode to be rapid indeed. However, also note that the switch assembly 632 is capable to bidirectionally exchange information with the controller 206, if the switch assembly is reprogrammed to be in the standard operating mode or other operating modes.

The six states through which each switch assembly goes are now discussed. A first state into which a switch assembly enters is the POWER-UP state. An inventory process associated with the powering-up state of the chain of switch assemblies happens at a rate of about 5 switches/second, with a slight delay on the first switch assembly while waiting for the wireline voltage to stabilize on power-up. The switch assembly's firmware implements this state machine as described below. On each power-up, an active switch assembly that has a detonator present will take approximately 200 ms to run through this state machine. The switch assembly will first check if it has been previously fired (i.e., is there an inert flag set). If this flag is set, the switch assembly will go to sleep. Otherwise, the switch assembly will start scanning the head voltage (i.e., the voltage between lines 204 and 208 in FIG. 6) by reading an analog-to-digital converter's input $V_{IN}$, and not take any further action unless the following two conditions are met:

(1) The line voltage is stable (e.g., the line voltage has not changed by more than 5V) at a value less than 90V for the last T1 seconds (e.g., T1=16 ms); and (2) The switch assembly has been powered up for at least T2 seconds (e.g., T2=20 ms).

By requiring that these two conditions are met, the switch assembly cannot get into a firing state, as a result of the firing voltage being immediately applied, either intentionally or due to the line 'browning out' after firing a previous switch assembly. The head voltage reading that is described above will be referenced later to determine if the feedthrough line is shorted. Once the required conditions have been met, the switch assembly will check for the presence of a detonator. Note that all future timings of the switch assembly is based on the time at which the switch assembly exits this state (i.e., a pulse generated by the switch 200 ms after the power-up action is actually referenced as being 180 ms after leaving this state).

Each switch assembly in the string will end up in one of 3 possible states after power-up:

- It will determine that it cannot fire, due to not having a detonator or having previously been set as 'inert,' and will go to sleep; or
- It will determine that it is able to fire and that there is another detonator-equipped switch assembly below it, in which case it will enable power to the lower switch assembly and then go to sleep; or
- It will determine that it is able to fire and that there are no detonator-equipped switch assemblies below it, in which case it will dump-fire on the detonator if a line voltage is sensed to be larger than the firing voltage (e.g., 140V) within a given time window (for example, a 45-second window).

Note that these states are configured to operate each switch assembly independent of the controller 206, i.e., no instructions from the controller 206 are required.

A second state of the switch assembly is the DETONATOR CHECK state. Once the switch assembly's line voltage has stabilized, it will check whether or not it senses a detonator. The presence of a detonator essentially means that there is a 50-ohm resistor connected between the wireline armor line 208 (see FIG. 6) and the line 212A (see FIG. 6) connecting the detonator switch 236A to the detonator 230A. This determination is made by the processor $P_A$ by sensing an appropriate voltage for the detonator. If the voltage sensed on the detonator line is larger than 20V, the processor $P_A$ of the switch assembly 232A determines that a detonator 230A is present. If no detonator is detected, the micro-controller instructs the switch assembly to go to sleep and would not attempt to communicate with the surface controller or any other switch assemblies. If a detonator is detected by the micro-controller, the micro-controller of the switch assembly will place a short (~24 μs) pulse on the line (204A-i) to alert the next switch assembly (above) that there is a switch assembly below with a detonator. The switch assembly will then do nothing for 75 ms, following which it will check its feedthrough connection 204A-o.

A third state of the switch assembly is the FEEDTRHROUH or thru-line check state. The feedthrough check will make a determination of whether or not the feedthrough line 204A-o is shorted. If the feedthrough line is shorted, there will be a voltage that is close to $V_{IN}$ present on line 204A-o. A voltage on this line is measured and if it is within 5V of the voltage $V_{IN}$, the micro-controller of the switch assembly determines that the feedthrough line is shorted. If the feedthrough line is shorted, the micro-controller of the switch assembly decides that it must be the final switch assembly in the string and so it goes to the PRE-FIRE state. If the feedthrough line is not shorted, the micro-controller of the switch assembly will enable its bypass line (i.e., close the thru-line switch 234A) and prepare to listen for a 24 μS pulse indicating that a switch assembly below has a detonator. The terms "below" and "above" are used herein to mean "downstream" and "upstream" relative to a well.

A fourth state of the switch assembly is the LISTEN state for a lower switch assembly. As noted above, a switch assembly will not do anything after power is applied, until it has been powered on for at least 20 ms and its head voltage is stable. The 'Listen' state is entered directly after the feedthrough line has been enabled, and the first thing that the micro-controller will do during the 'Listen' state is to wait for 15 ms and then enable an interrupt to be triggered if a pulse from a lower switch assembly is detected. The micro-controller will then wait another 15 ms, turn off the bypass (i.e., switch 234A) to a lower switch assembly, and then check whether or not an interrupt was generated inside the listening window. If an interrupt was not generated, the switch assembly determines that there are no detonator-equipped switch assemblies below it and so it will go to the PRE-FIRE state. If an interrupt was generated, this will be interpreted as a lower switch assembly having a detonator is present and the micro-controller will go to the INLINE state.

A fifth state of the switch assembly is the INLINE state. If a switch assembly is in this state, it has determined that it has a detonator and that there is a switch assembly below it that also has a detonator. The micro-controller will inform the surface controller that it is an inline switch assembly by sending two long pulses P1 and P2, at times T3 and T4 (e.g., T3=180 ms and T4=200 ms after power-up). Immediately after this, the micro-controller will enable the bypass line (thru-switch 234A) for the next switch assembly to start its inventory process, and then go to sleep to minimize current consumption.

A sixth state of the switch assembly is the PRE-FIRE state. If a switch assembly reaches this state, it has determined that it has a detonator, but there are no detonator-equipped switch assemblies below it. The micro-controller will inform the surface controller, through the transmit module 270, that it is a terminating switch assembly. The micro-controller will send two long pulses P3 and P4 at times T5 and T6 (for example, T5=190 ms and T6=200 ms), and then prepare to dump fire on the detonator when the line voltage is detected to be above the firing voltage (e.g., 140V). Immediately after sending these two pulses, the switch assembly will start a timer for measuring a time window (e.g., 45-second timer) and then again verify that its head voltage is below 90V and stable for at least 20 ms. Once this has been confirmed, it will start reading its head voltage to determine if a voltage larger than the firing voltage (e.g., 140V) is present. If the voltage larger than the firing voltage is detected, the micro-controller will mark itself as inert for any future power-ups, and then enable the fire line 212A. If the 45-second timer expires before the firing voltage is sensed, the switch assembly will go to sleep and a power cycle will be required to reconfigure the string of switch assemblies.

A further state, which is optional, is the SETTING TOOL CHECK state. Alternatively, one of the previous states may be modified to include the functionality discussed herein. Once the switch assembly's line voltage has stabilized, it will check whether or not it senses a setting tool. In one application, the switch assembly would also check for the presence of a detonator not related to the setting tool. This determination is made by the processor $P_A$ by sensing an appropriate voltage for the setting tool. If the processor $P_A$ of the switch assembly 632C determines that a setting tool 202 is present, the switch assembly sends two pulses to the surface controller to inform about this determination. Further, the switch assembly 632C will place a short (~24 μs) pulse on the line (204C-i) to alert the next switch assembly (above) that there is a switch assembly below with a setting tool and/or a detonator. The two pulses may be separated by 15 ms as previously discussed. If no setting tool is detected and no detonator is detected, the micro-controller instructs the switch assembly to go to sleep and would not attempt to communicate with the surface controller or any other switch assemblies. If no setting tool is detected but only a detonator is detected, the micro-controller of the switch assembly will place a short (~24 μs) pulse on the line (204A-i) to alert the next switch assembly (above) that there is a switch assembly below with a detonator. The switch assembly will then do nothing for 75 ms, following which it will check its feed-through connection 204A-o.

One skilled in the art would understand that the times and voltages used to describe the 6 (7) states above are exemplary and other values may be used. Also, one skilled in the art would understand the simplicity of the communication scheme used by the micro-controllers for communicating with the surface controller or with other micro-controllers from the chain. In this respect, the examples discussed above use simply pulses with different time separations for communication. Thus, no digital address of the micro-controller is necessary for performing this type of communication.

Figure 8:
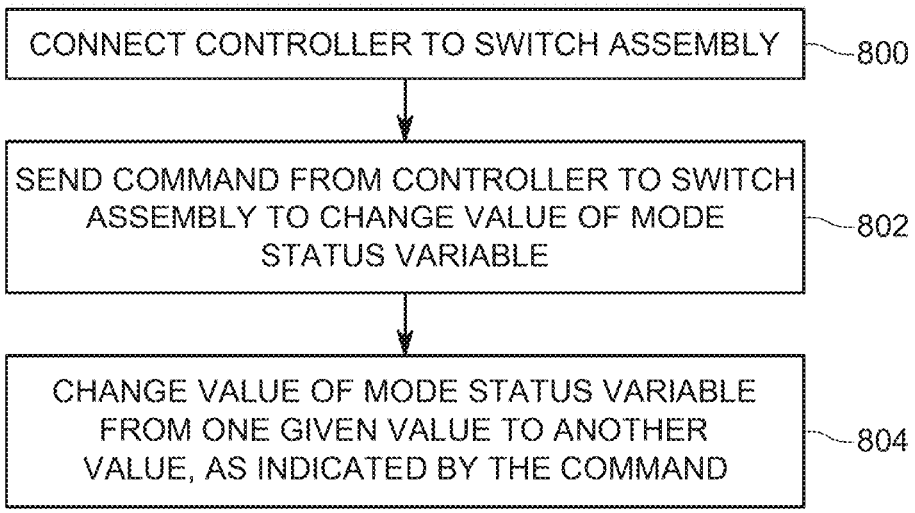
FIG. 8 is a flow chart of a method for configuring an operation mode of one or more convertible and addressable switch assemblies.

A method for converting the switch assembly 632 from one operating mode to another operating mode is now discussed with regard to FIG. 8. The method starts in step 800, when the operator connects the surface controller 206 to a part or the entire gun string, and sends in step 802 a command directed to the switch assembly 632 that needs to be converted. Note that all the switch assemblies 632 in the gun string 200 or 700 share the structure illustrated in FIG. 6, i.e., each switch assembly is configured to directly communicate with the surface controller or directly communicate with additional switch assemblies. The command includes information for changing a value of a mode status variable stored by each switch assembly in its memory 238. For example, if the default value of the mode status variable is zero, which corresponds to the standard operating mode, the command sent by the surface controller 206 includes instructions so that the switch assembly 632 changes in step 804 that variable from zero to one, where one is associated with the rapid fire operating mode. If more values are need for the mode status variable, for example, to also implement the set/fire operating mode, or the rapid fire set/fire operating mode, etc., then more than one digit may be used, i.e., 00 for the standard operating mode, 11 for the rapid fire operating mode, 01 for the set/fire operating mode, 10 for the rapid fire set/fire operating mode, etc. One skilled in the art would understand that any number of values may be implemented for the mode status variable, either using the digits 0 and 1, or in any other know way.

In step 806, the processor of the switch assembly erases the previous value of the mode status variable from the non-volatile memory and stores the new value, received from the surface controller 206. In one embodiment, the steps of sending, changing, and storing are repeated for each switch assembly in the gun string. However, in another embodiment, the steps of sending, changing, and storing are taking place only for the first switch assembly of the gun string.

The operation of setting up the value of each mode status variable by the operator of the well may be performed at the surface, when all the switch assemblies are on the ground, or after the entire gun string has been assembled and lowered into the well. In other words, the telemetry used for controlling the switch assemblies illustrated in FIG. 6 allow to convert the switch assemblies from one operation mode to another operation mode no matter the location of the switch assemblies. Note that this operation may be performed when the controller is connected to a single switch assembly, to some of the switch assemblies, or to all the switch assemblies of the gun string 700. In one application, when all the switch assemblies 632 are connected to the controller 206, it is possible to change one, a sub-set or all of the switch assemblies of the gun string, from one value to another value. In still another embodiment, it is possible to change a switch assembly from a first value to a second value, which is different from the first value, to change another switch assembly in the gun string from the first value to a third value, which is different from the first and second values, and so on. In other words, the controller can selectively change the value of the mode status variable of one or more switch assemblies to various desired values, either sequentially, or during a same operation. Any one or combination of the step and processes discussed with regard to FIG. 8 may take place at the manufacturing plant of the switch assembly, in which case the surface controller 206 is a computer system that belongs to the operator of the plant, and the telemetry system 205 includes any wiring that connects the controller to the switch assembly. The steps associated with the method illustrated in FIG. 8 may be performed on each switch assembly while only that switch assembly is connected to the controller, or when all the switch assemblies or some of the switch assemblies are together connected to the controller. If the switch assembly 632 is directly connected to the controller in the manufacturing plant, the telemetry system 205 refers to the wiring used to connect the controller to the switch assembly, the interface I/O shown in FIG. 3A may be used as the port that communicates with the controller, and the processor $P_A$ is performing, together or not with the controller, the various steps discussed in the method illustrated in FIG. 8. In other words, all the steps discussed with regard to this method can be performed by the manufacturer of the switch assembly, in a plant, hundreds of kilometers from the well, or by the operator of the well, while the switch assemblies are on the ground, next to the well, or already deployed in the well. This means that in one application, existing addressable switch assemblies may be modified in firmware to perform the steps discussed herein and to convert from one operating mode to another.

In one application, the steps of sending, changing, and storing discussed above with regard to FIG. 8 are taking place only for one switch assembly of the gun string and this switch assembly is the first in the chain of the switch assemblies. In this application or another application, each of the first and second operating modes is one of a standard operating mode, rapid fire operating mode, set/fire operating mode, rapid fire set/fire operating mode, and ballistic release tool operating mode. Other modes may also be defined by the operator according to the needs of each well.

The standard operating mode uses bidirectional communication of data between the surface controller and the switch assembly. The rapid fire operating mode uses no data communication (only one or more currents or voltages having different values are transmitted along the telemetry system; data communication is understood herein to include a command that includes a digital address that identifies a switch assembly and additional information that instructs the specific switch assembly associated with the digital address to perform a specific function) between the surface controller and the switch assembly for firing the switch assembly, so that the rapid fire operating mode takes less time than the standard operating mode. The set/fire mode is used when the switch assembly is connected between a gun assembly and a setting tool, and the ballistic release tool mode is used on a first switch assembly in the gun string to release the gun string inside the well.

After the switch assemblies of the gun string have been configured (converted) to operate in the desired operating mode, the gun string is now ready to be operated. Note that by using the same structure for all the switch assemblies, no matter of the operating mode, and having the capability to set each switch assembly to a desired operating mode, which can differ from the original purpose of the switch assembly, there is no need for the operator to forecast what type of switch assembly to use for a given well, and avoids the need of having to use different switch assemblies if the conditions at the well have been changed, which is not only time consuming, but also expensive and prone to mistakes.

Having the gun string assembled inside the well, the operator now is ready to fire the shaped charges of the plural gun assemblies of the gun string 700. In the embodiment illustrated in FIG. 9, the operator starts in step 900 by powering up the gun string, i.e., sending a small current (much smaller than the firing current) from the controller 206 to the switch assemblies 632. The local processor $P_A$ of each switch assembly can, at this early point in the process, check in step 902 the value of the mode status variable. If the value is associated with the standard operating mode, then the method continues to step 402 in FIG. 4A and follows the remainder of the steps shown there and discussed above.

However, if the value is determined in step 902 to be associated with the rapid fire operating mode discussed above with regard to FIG. 7, then the method proceeds in step 906 with the rapid fire operating mode and activates the switch assemblies by using, in this embodiment, only a change in the voltage applied to the gun string, and no commands specifically addressed to each switch assembly. In other words, for the rapid fire operating mode, the digital address of the switch assembly is not used for instructing the switch assembly to fire the detonator. Those skilled in the art would understand that the switch assembly may be activated in other ways as long as no commands are sent from the controller 206.

Figure 9:
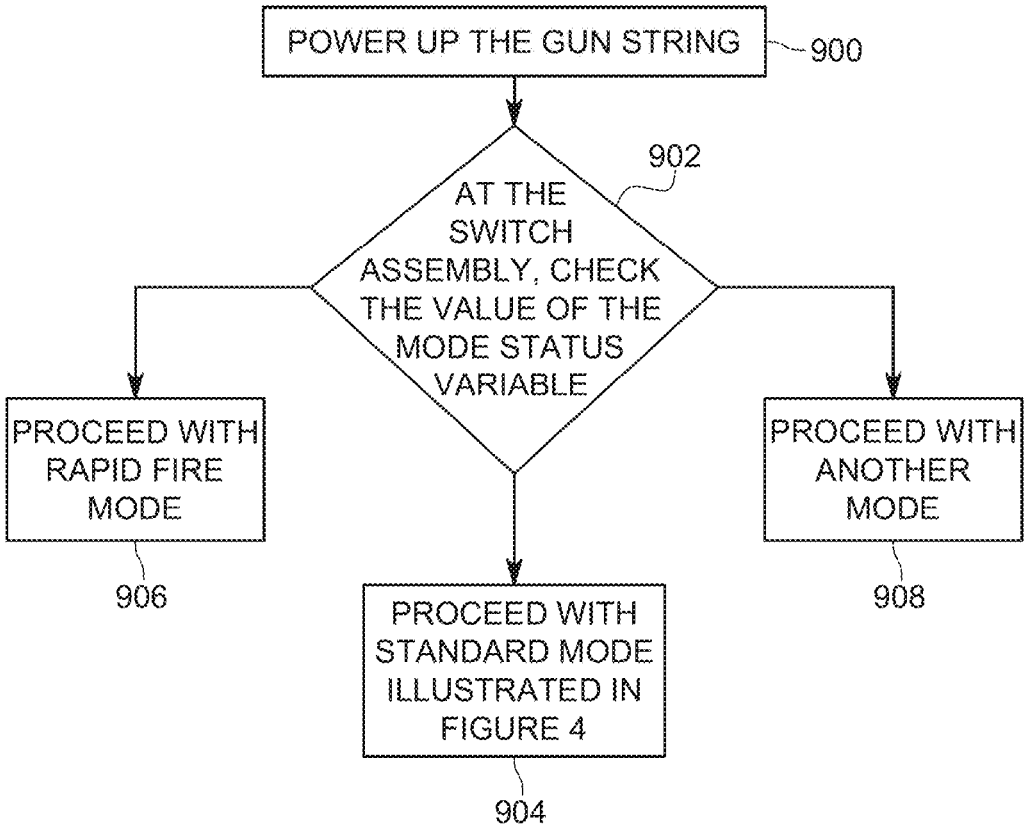
FIG. 9 is a flow chart of a method for operating the one or more convertible and addressable switch assemblies.

It is also possible that in step 902 is determined that the value of the mode status variable is associated with the BRT operating mode or the set/fire operating mode, in which case, in step 908, the method proceeds with that mode. Both the BRT and the set/fire operating modes have been described above. In this way, the method illustrated in FIG. 9 is capable to select, based on the value of the mode status variable, which operating mode to implement for the switch assemblies of the gun string 700.

In one application, the plural operating modes includes a standard operating mode and rapid fire operating mode, where the rapid fire operating mode fires the switch assembly in less time than the standard mode. In another application, the plural operating modes include two or more of a standard operating mode, a rapid fire operating mode, a set/fire operating mode, and a ballistic release tool operating mode. In this application, the standard operating mode uses bidirectional communication of data between the surface controller and the switch assembly, the rapid fire operating mode uses no data communication between the surface controller and the switch assembly for firing the switch assembly, so that the rapid fire operating mode takes less time than the standard operating mode, the set/fire operating mode is used when the switch assembly is connected between a gun assembly and a setting tool, and the ballistic release tool operating mode is used on a first switch assembly in the gun string to release the gun string inside the well. In one application, the steps of checking and initiating take place while the switch assembly is in the well. It is also possible that the steps of checking and initiating are taking place only for a single switch assembly of the gun string and the switch assembly is the first in a chain of the switch assemblies.

The disclosed embodiments provide methods and systems for selectively actuating one or more gun assemblies in a gun string according to a desired operating mode, which is stored at the switch assemblies. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A convertible and addressable switch assembly that is part of a chain of switch assemblies in a gun string, the switch assembly comprising:

an interface (I/O) configured to connect to a surface controller along a telemetry system; and a processor connected to the interface (I/O) and configured to, receive a command from the surface controller, along the telemetry system, to change a first value of a mode status variable to a desired second value, wherein the first value is associated with a first operating mode of the switch assembly and the second value is associated with a second operating mode, which is different from the first operating mode;

change the first value to the second value; and store in a non-volatile memory the second value of the mode status variable, wherein the first operating mode is related to firing perforating guns of the gun string, based on communication with the surface controller, while the second operating mode is related to rapidly firing the perforating guns, based on a reduced communication with the surface controller, relative to the first operating mode.

2. The switch assembly of claim 1, wherein the changing and storing take place while the switch assembly is located at the surface.

3. The switch assembly of claim 1, wherein the changing and storing take place while the switch assembly is in a well.

4. The switch assembly of claim 1, wherein the sending, changing, and storing are repeated for each switch assembly in the gun string.

5. The switch assembly of claim 1, wherein the sending, changing, and storing are taking place only for the switch assembly of the gun string and the switch assembly is the first in the chain of the switch assemblies.

6. The switch assembly of claim 1, wherein each of the first and second operating modes is one of a standard operating mode, a rapid fire operating mode, a set/fire operating mode, and a ballistic release tool operating mode.

7. The switch assembly of claim 6, wherein the standard operating mode uses bidirectional communication of data between a surface controller at a well and the switch assembly.

8. The switch assembly of claim 7, wherein the rapid fire operating mode uses less data communication between the surface controller and the switch assembly for firing the switch assembly when compared to the standard operating mode, so that the rapid fire operating mode takes less time than the standard operating mode.

9. The switch assembly of claim 8, wherein the set/fire operating mode is used when the switch assembly is connected between a gun assembly and a setting tool.

10. The switch assembly of claim 9, wherein the ballistic release tool operating mode is used when the switch assembly is a first switch assembly in the gun string, to release the gun string inside the well.

11. A method for firing a switch assembly that is part of a gun string, the method comprising:

receiving power at the switch assembly from a surface controller;

checking at the switch assembly a value of a mode status variable stored in a non-volatile memory; and based on the value of the mode status variable, initiating the switch assembly according to one of plural operating modes that include a first operating mode and a second operating mode, wherein each of the plural operating modes is different from other operating modes of the plural operating modes, and wherein the first operating mode is related to firing perforating guns of the gun string, based on communication with a surface controller, while the second operating mode is related to rapidly firing the perforating guns, based on a reduced communication with the surface controller, relative to the first operating mode.

12. The method of claim 11, wherein the plural operating modes includes a standard operating mode and a rapid fire operating mode, where the rapid fire operating mode fires the switch assembly in less time than the standard operating mode.

13. The method of claim 11, wherein the plural operating modes include two or more of a standard operating mode, a rapid fire operating mode, a set/fire operating mode, and a ballistic release tool operating mode.

14. The method of claim 13, wherein the standard operating mode uses bidirectional communication of data between the surface controller and the switch assembly.

15. The method of claim 14, wherein the rapid fire operating mode uses less data communication between the surface controller and the switch assembly for firing the switch assembly, so that the rapid fire operating mode takes less time than the standard operating mode.

16. The method of claim 15, wherein the set/fire operating mode is used when the switch assembly is connected between a gun assembly and a setting tool.

17. The method of claim 16, wherein the ballistic release tool operating mode is used on a first switch assembly in the gun string to release the gun string inside the well.

18. The method of claim 11, wherein the steps of checking and initiating take place while the switch assembly is in the well.

19. The method of claim 11, wherein the steps of checking and initiating are taking place only for the switch assembly of the gun string and the switch assembly is the first in a chain of the switch assemblies.

20. A convertible and addressable switch assembly configured to be connected to a gun assembly in a gun string for firing the gun assembly, the switch assembly comprising:

a processor configured to check a value of a mode status variable;

a memory configured to store (1) the value of the mode status variable and (2) a unique digital address that makes the switch assembly addressable;

a through switch configured to allow a signal from a surface controller to pass to a next switch assembly;

a detonator switch configured to close an electrical circuit to a detonator to detonate the detonator; and a transceiver configured to directly communicate with the next switch assembly, wherein the value of the mode status variable is associated with plural operating modes, wherein by changing the value of the mode status variable, the switch assembly is converted from a first operating mode to a second operating mode, and wherein the first operating mode is related to firing perforating guns of the gun string, based on communication with a surface controller, while the second operating mode is related to rapidly firing the perforating guns, based on a reduced communication with the surface controller, relative to the first operating mode.

* * * * *